US005499877A

United States Patent [19]

Sakanishi et al.

[11] Patent Number: 5,499,877

[45] Date of Patent: Mar. 19, 1996

[54] TRANSFER RIBBON CASSETTE, A CASE FOR ENCLOSING THE CASSETTE, AND A PAINT FILM TRANSFER DEVICE HAVING THE SAME

[75] Inventors: Yutaka Sakanishi; Kotaro Akashiro, both of Osaka, Japan

[73] Assignee: Fujicopian Co., Ltd., Japan

[21] Appl. No.: 222,453

[22] Filed: Apr. 4, 1994

[30] Foreign Application Priority Data

| | | | |
|---|---|---|---|
| Apr. 6, 1993 | [JP] | Japan | 5-079437 |
| Sep. 3, 1993 | [JP] | Japan | 5-219491 |
| Sep. 9, 1993 | [JP] | Japan | 5-224089 |
| Sep. 16, 1993 | [JP] | Japan | 5-229926 |
| Sep. 30, 1993 | [JP] | Japan | 5-244934 |

[51] Int. Cl.[6] ..... B41J 35/02; B41J 35/28

[52] U.S. Cl. ..... 400/193; 400/196; 400/208

[58] Field of Search ..... 400/193, 196, 400/207, 208, 208.1, 695, 696, 697.1, 697, 700

[56] References Cited

U.S. PATENT DOCUMENTS

| | | | |
|---|---|---|---|
| 2,400,435 | 5/1946 | Nelson et al. | 156/DIG. 48 |
| 2,982,984 | 5/1961 | Discipio | 401/208 |
| 3,889,310 | 6/1975 | Barouh et al. | 15/210 R |
| 4,350,453 | 9/1982 | Field et al. | 400/208 |
| 4,671,687 | 6/1987 | Tamai | 400/208 |
| 4,676,678 | 6/1987 | Watanabe | 400/208 |
| 4,861,177 | 8/1989 | Heins et al. | 400/208 |
| 5,125,589 | 6/1992 | Manusch | 242/67.3 R |
| 5,160,206 | 11/1992 | Haftmann et al. | 400/250 |

FOREIGN PATENT DOCUMENTS

| | | | |
|---|---|---|---|
| 0285024 | 10/1988 | European Pat. Off. | 400/193 |
| 0380978 | 8/1990 | European Pat. Off. . | |
| 0380977 | 8/1990 | European Pat. Off. . | |
| 0427870 | 5/1991 | European Pat. Off. . | |
| 0008077 | 1/1989 | Japan | 400/193 |
| 387283 | 4/1991 | Japan | B41J 32/00 |
| WO9117108 | 11/1991 | WIPO . | |

*Primary Examiner*—Christopher A. Bennett

*Attorney, Agent, or Firm*—Webb Ziesenheim Bruening Logsdon Orkin & Hanson

[57] ABSTRACT

A transfer ribbon cassette a feed core for winding a transfer ribbon having a transfer film applied to one surface thereof, a takeup core for taking up the transfer ribbon fed from the feed core, a case for containing the feed core and takeup core, and a holder for supporting the feed core and takeup core in a relative positional relationship for mounting in the case. Each core is rotatably supported at one end thereof and, when mounted in the case, has a free axial end thereof supported by the case. This cassette may be used as a paint film transfer device.

20 Claims, 13 Drawing Sheets

TRANSFER RIBBON CASSETTE, A CASE FOR ENCLOSING THE CASSETTE, AND A PAINT FILM TRANSFER DEVICE HAVING THE SAME

BACKGROUND OF THE INVENTION

1. Field of the Invention

This invention relates transfer ribbon cassettes. More particularly, the invention relates to a transfer ribbon cassette having a transfer ribbon wound around a feed core and a takeup core maintained in predetermined relative positions by a holder for mounting in a case, the transfer ribbon having a transfer paint film applied to one surface thereof, such as a paint film for use in correcting characters, an adhesive film for bonding purposes or a colored paint film for ornamental use. The invention relates also to a case for enclosing this cassette, and to a paint film transfer device having the cassette.

2. Description of the Related Art

A conventional transfer ribbon cassette, as shown in FIG. 28, has a pair of fight and left plates 01 connected to each other through spacers 05, with a space therebetween corresponding to a ribbon width. A transfer ribbon R is wound around a feed core 02 and a takeup core 03 supported by a holder 04 in the form of a box-like frame. The two cores 02 and 03 are supported at opposite axial ends thereof by the pair of plates 01, and fixed to a relative positional relationship to be placed in a transfer device case.

Thus, the holder 04 not only requires numerous materials for manufacture, but has a complicated construction. Its fabrication and assembly of the feed core 02 and takeup core 03 are of low productivity, consuming a great deal of time and trouble. Such a transfer ribbon cassette has the disadvantage of high manufacturing cost.

SUMMARY OF THE INVENTION

The present invention has been made having regard to the state of the art noted above. A primary object of the present invention, therefore, is to provide a transfer ribbon cassette which may be manufactured at lower cost than the conventional transfer ribbon cassette, with an improved support structure for the feed core and takeup core, as well as a case for enclosing this transfer ribbon cassette.

A further object of the present invention is to provide a paint film transfer device having the above transfer ribbon cassette and easy to use.

The above primary object is fulfilled, according to the present invention, by a transfer ribbon cassette as noted at the outset hereof, wherein each of the feed core and takeup core is rotatably supported at one end thereof and, when mounted in the case, has a free axial end thereof supported by the case.

In the above construction, each core is supported at one end thereof by the holder and at the other end by the case when mounted in the case. Thus, the holder for supporting the feed core and takeup core need not be formed in a box-like frame capable of supporting opposite axial ends of each core.

As a result, the holder has a simplified construction with less materials required for its manufacture. Its fabrication and assembly of the feed core and takeup core are carried out with greater ease and higher productivity and at less cost than in the prior art.

Each core may have a first restrictor defined at the free axial end thereof for checking displacement of the transfer ribbon toward the free axial end.

When the transfer ribbon cassette is attached to the case with the free axial end of each core facing downward, the first restrictor prevents the transfer ribbon from slipping off the core. Even if the transfer ribbon wound around this core should contact the first restrictor, there would be no possibility of an increased resistance being applied to running of the transfer ribbon since the first restrictor is rotatable with the transfer ribbon wound on the core.

This construction facilitates reliable attachment to the case, requiring only a light operating force.

The transfer ribbon cassette may further comprise a transfer head for pressing the transfer ribbon upon a receiving surface to transfer the transfer film to the receiving surface, and second restrictors for checking transverse displacement of the transfer ribbon moving past the transfer head, the second restrictors being formed of resin integrally with the holder to support opposite ends of the transfer head transversely of the transfer ribbon.

This provides a simplified support structure for the transfer head, and allows the transfer ribbon to be wound around the transfer head in advance.

As a result, the transfer ribbon cassette may be manufactured at still less cost. The transfer ribbon cassette may be assembled to the case quickly and reliably without requiring skill since the transfer ribbon need not be passed around the transfer head in time of assembly.

The holder may rotatably support one end of each of the feed core and takeup core, such that a portion of the transfer ribbon extending from the feed core to the takeup core is visible through the holder.

With this construction, when the transfer ribbon cassette is attached to the case with the free end of each core directed toward the case, the portion of the transfer ribbon extending from the feed core to the takeup core may readily be held between a thumb and a finger.

This facilitates an operation to cause the transfer ribbon to extend along a ribbon guide path in the case, as necessary, when attaching the transfer ribbon cassette to the case.

In another aspect of the invention, a transfer ribbon cassette as noted in the outset hereof is provided, wherein each core is rotatably supported at one end thereof and, when mounted in the case, has a free axial end thereof supported by the case, the holder being removable from the feed core and takeup core.

In this construction, when the cores are placed in the case, the free end of each core is supported by the case. Thus, the holder for supporting the feed core and takeup core need not be formed in a box-like frame capable of supporting opposite axial ends of each core. The holder may be removed from the cores when the cores are attached to the case, and hence the holder need not be contained along with the cores in the case.

As a result, the holder has a simplified construction with less materials required for its manufacture. Its fabrication and assembly of the feed core and takeup core are carried out with greater ease and higher productivity and at less cost than in the prior art. In addition, the case may be formed small.

Moreover, since the holder is removable from the cores attached to the case, the holder may include a rotation stopper mechanism for the cores, to avoid relaxation of the transfer ribbon without being attached to the case.

A case for enclosing a transfer ribbon cassette, according to the present invention, comprises an elastic member elastically deformable upon closure of the case, and engaging members for maintaining the case in a closed position. When the engaging members are disengaged, the elastic member returns to an original shape.

When the engaging members maintaining the case in the closed position are disengaged, the restoring force of the elastic member moves the engaging members to positions not to be engageable.

This construction has the advantage of facilitating opening of the case, compared with manual opening of the case while disengaging the engaging members.

A paint film transfer device according to the present invention comprises a slip interlock mechanism including a large diameter pulley rotatable with the feed core, a small diameter pulley rotatable with the takeup core, and a transmission belt wound around the large diameter pulley and the small diameter pulley.

With this construction, the slip interlock mechanism has no play such as backlash therein. Even when the slip interlock mechanism is moved in either direction while the transfer ribbon cassette is detached from the case, the takeup core rotates with the feed core at an initial stage of rotation of the feed core in a first transfer operation after the transfer ribbon cassette is loaded into the case. Consequently, a used portion of the transfer ribbon in light contact with the transfer ribbon on the feed core has no possibility of moving past a predetermined peeling position to be drawn onto the feed core. The used portion of the transfer ribbon is not relaxed before the takeup core starts taking up the used portion. Thus, the used portion of the transfer ribbon is taken up on the takeup core under suitable tension.

This construction provides the advantage of reducing the torque of the takeup core necessary for taking up the used portion of the transfer ribbon. At the same time, the used portion of the transfer ribbon to be taken up on the takeup core imparts little resistance to feeding of the transfer ribbon from the feed core during a first transfer operation after the transfer ribbon cassette is loaded into the case. Consequently, the transfer ribbon may run in a normal way, and a used portion of the transfer ribbon may be taken up on the takeup core in a normal way, both from the beginning of a transfer operation.

The paint film transfer device according to the present invention may include a stationary support shaft for rotatably supporting a tubular shaft which in turn supports a transfer ribbon winding core, and a restrictor formed between the support shaft and tubular shaft for inhibiting the tubular shaft from moving out of the support shaft.

The transfer ribbon winding core may be removed from the tubular shaft inhibited from moving out of the support shaft. Consequently, the transfer ribbon winding core may be removed from the tubular shaft with ease while the components of the interlock mechanism are retained in interlocked state.

The restrictor may include engaging members for engaging the support shaft with the tubular shaft, the engaging members being elastically movable to a disengaging position, and a pressing surface for moving the engaging members to the disengaging position during an operation to fit the tubular shaft on the support shaft.

With this construction, the tubular shaft may be fitted on and engaged with the support shaft in a way to inhibit movement of the tubular shaft out of the support shaft. This paint film transfer device has excellent operability for assembling the tubular shaft to the support shaft.

In a further aspect of the invention, a paint film transfer device comprises a transfer ribbon cassette including a feed core and a takeup core, each rotatably supported at one end thereof by a plate-like holder, for winding a paint film transfer ribbon, and a case openable and closable for removably containing the transfer ribbon cassette, the case supporting free axial ends of the feed core and the takeup core when the transfer ribbon cassette is mounted therein, wherein the case is divided into a first and a second split case members detachably attachable to each other transversely of the transfer ribbon, the case being openable and closable by attachment and detachment of the first and second split case members, the plate-like holder being disposed between the first and second split case members to check movement of the plate-like holder in directions of thickness thereof.

When mounted in the case, one end of each core is supported by the plate-like holder, while the other end is supported by one of the split case members. The holder for supporting the feed core and takeup core need not be formed in a box-like frame capable of supporting opposite axial ends of each core. The transfer ribbon cassette may be reduced in size, and the case itself may also be small.

Even though the plate-like holder may be slightly flexed due to a residual stress or the like produced at manufacturing time, an external force is applied to the plate-like holder in a direction to rectify the flexure when the transfer ribbon cassette is mounted in the case. That is, the plate-like holder is pressed between the two split case members.

As a result, the holder has a simplified construction, so that the transfer ribbon cassette requires less materials for its manufacture. Its fabrication and assembly of the feed core and takeup core are carried out with great ease. The transfer ribbon cassette and the case may be reduced in size also. Thus, the paint film transfer device according to the present invention requires less manufacturing cost and less transportation cost than in the prior art. Further, the transfer ribbon may run in a trouble-free manner since the feed core and takeup core are reliably maintained in desired postures when the transfer ribbon cassette is mounted in the case.

The first and second split case members may include reinforcing ribs formed on inner peripheral surfaces thereof for reinforcing the first and second split case members, respectively, the plate-like holder being disposed between the reinforcing ribs to check movement of the plate-like holder in the directions of thickness thereof, the reinforcing ribs formed on at least one of the first and second split case members extending into and contacting the other split case member to check relative displacement between the first and second split case members in directions of thickness of the transfer ribbon.

The ribs for reinforcing the split case members also serve to check movement of the plate-like holder in the directions of thickness thereof, and to check relative displacement between the first and second split case members in directions of thickness of the transfer ribbon.

Since the reinforcing ribs extending into the case are utilized to check movement of the plate-like holder in the directions of thickness thereof, no special restrictor is required, thereby promoting simplification of the construction. The reinforcing ribs provide rigidity against external forces acting on the closed split case members in the directions of ribbon thickness.

In the paint film transfer device, the transfer ribbon may have a substantially entire length feedably wound on the feed core, with an outside diameter (E) of winding of the entire length set to the following ratio with respect to an outside diameter (d) of the feed core:

*outside diameter (E)/outside diameter (d)=2.2 at most.*

FIG. 19 shows a relationship between feeding length L of the transfer ribbon fed from the feed core and tension T of the transfer ribbon required for feeding the ribbon from the feed core. As shown in FIG. 20, an adhesive film transfer ribbon R having a total length of about 10 m (about 45 micrometers thick) is wound on a feed core 1 having a varied outside diameter "d". For varied transfer ribbon windings R0 having different ratios of outside diameter E with respect to the outside diameter "d" of the feed core 1, a radius "r" of each transfer ribbon winding R0 is calculated when every 1 m of the transfer ribbon is drawn out. A minimum torque M0 necessary for starting rotation of the feed core 1 is fixed to 390 gf. cm. Tension T of the transfer ribbon R is derived from the following equation and shown in the graph:

$$T=M0/r.$$

As seen from the results of calculation, when, with a substantially entire feedable length of the transfer ribbon is wound on the feed core 1, the ratio (E/d) of outside diameter E of the transfer ribbon winding R0 with respect to the outside diameter "d" of the feed core 1 exceeds 2.2, tension T of the transfer ribbon requited for feeding the ribbon from the feed core 1 sharply increases with a decrease in the amount of transfer ribbon R wound on the feed core 1.

Where the ratio (E/d) with respect to the outside diameter "d" of the feed core does not exceed 2.2, the tension of the transfer ribbon necessary for drawing the transfer ribbon from the feed core does not increase greatly over the substantially entire length of the transfer ribbon. This provides excellent operability since the operating feeling is little changed.

The paint film transfer device may further comprise a transfer head in form of a transfer roller movable upstream with respect to a direction of ribbon feeding from the feed core, while pressing a transfer surface of the transfer ribbon upon a receiving surface, the transfer roller having an outside diameter of 8 mm to 20 mm.

FIG. 21 shows a relationship between outside diameter Dr of the above transfer roller and coefficient of dynamic friction μ between transfer roller periphery and transfer ribbon. The graph of FIG. 21 has been obtained as follows.

As shown in FIG. 22, each of transfer rollers 4 has a varied outside diameter Dr in the range of 8 mm to 20 mm, with an outer peripheral surface having a spring hardness Hs (JISA) set to about 60 degrees. Each transfer roller 4 is fixed, and adhesive film transfer ribbon R (about 45 micrometers thick) is wound on a peripheral surface of the roller with an adhesive film facing outward, at a substantially fixed winding angle Θ set to about 90 degrees. A weight W of 50 gf is suspended from one end of the transfer ribbon R to apply tension T of 50 gf to the transfer ribbon R. A load cell LS connected to the other end of the transfer ribbon R is moved at a velocity V of about 20 mm/sec. in the direction indicated by an arrow. The coefficient of dynamic friction μ is derived from the following equation, which disregards centrifugal influences:

$$\mu=(1/\Theta)\log(TL/T)$$

where TL is a tension measured with the load cell LS, T is the tension applied by the weight W, and (3 is the winding angle of the transfer ribbon R. The values thus obtained are plotted in the graph of FIG. 21.

As seen from the results of measurement, the coefficient of dynamic friction μ shows a sharp decrease when the outside diameter Dr of the transfer roller 4 is less than 8 mm. As a result, the transfer ribbon R tends to slip on the outer periphery of the transfer roller 4.

Thus, the coefficient of dynamic friction between the transfer roller and transfer ribbon may be set to a large value to check slippage between the outer periphery of the transfer roller and the transfer ribbon. This enables an efficient transfer operation.

The transfer roller may include a peripheral surface having a roller width (kr) set to the following ratio with respect to a width (K) of the transfer ribbon: roller width (Kr)/ribbon width (K)=1.2 to 2.5.

FIG. 23 shows a relationship between the ratio (Kr/K) of the roller width Kr with respect to the ribbon width K and a minimum pressing force F applied from the transfer roller to a receiving surface as required to draw the transfer ribbon from the feed core. As shown in FIG. 24, an adhesive film transfer device includes a feed core 1 for winding an adhesive film transfer ribbon R (about 45 micrometers thick), a transfer roller 4 for pressing the transfer ribbon R fed from the feed core 1 upon a receiving surface B, and a takeup core 2 for taking up the transfer ribbon R having passed the transfer roller 4. The ratio (Kr/K) of the roller width Kr with respect to the ribbon width K is varied, with the tension T required to draw the transfer ribbon R from the feed core 1 being set to about 200 gf. For varied ratios (Kr/K), minimum pressing force F required for transfer at transfer velocity V of about 20 mm/sec. is measured while pressing the transfer roller 4 against transfer paper acting as the receiving surface B. Measurements F are plotted in the graph of FIG. 23.

As seen from the results of measurement, when the ratio (Kr/K) of the roller width Kr with respect to the ribbon width K is less than 1.2, the necessary minimum pressing force F increases sharply.

When the ratio (Kr/K) of the roller width Kr with respect to the ribbon width K is in the range of 1.2 to 2.5, a small minimum pressing force is required from the transfer roller to the receiving surface to draw the transfer ribbon from the feed core. This enables a transfer operation to be carried out with a light operating force.

DETAILED DESCRIPTION OF THE PREFERRED EMBODIMENTS

Transfer ribbon cassettes embodying the present invention will be described in detail with reference to the drawings.

Figure 1:
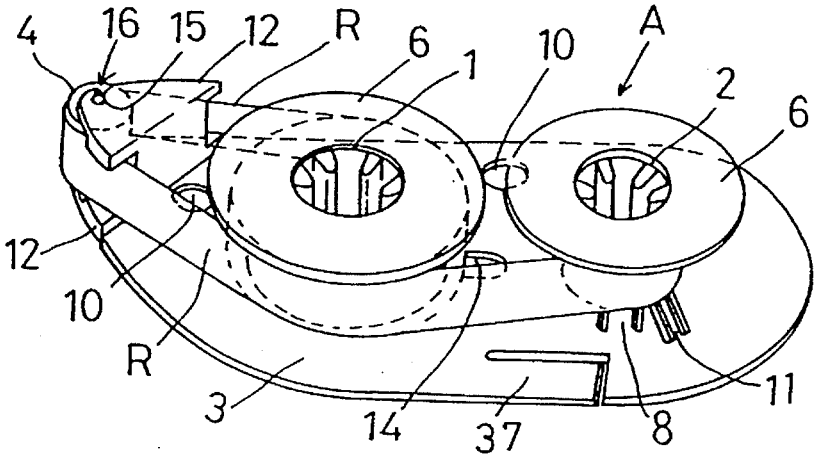
FIG. 1 is a perspective view of a transfer ribbon cassette according to the present invention.

FIG. 1 shows a transfer ribbon cassette A including a transfer ribbon R having an adhesive film D, which is one example of transfer films, applied to one surface thereof. The transfer ribbon R is wound around a plastic feed core 1 and a plastic takeup core 2, with the adhesive film D facing outward. The cores 1 and 2 are maintained in a predetermined positional relationship by a plastic, plate-like holder 3 to be mountable in a case C. The transfer ribbon cassette A further includes a press roller 4 acting as a transfer head for pressing the transfer ribbon R upon a receiving surface B such as of paper to transfer the adhesive film D to the receiving surface B.

Figure 2:
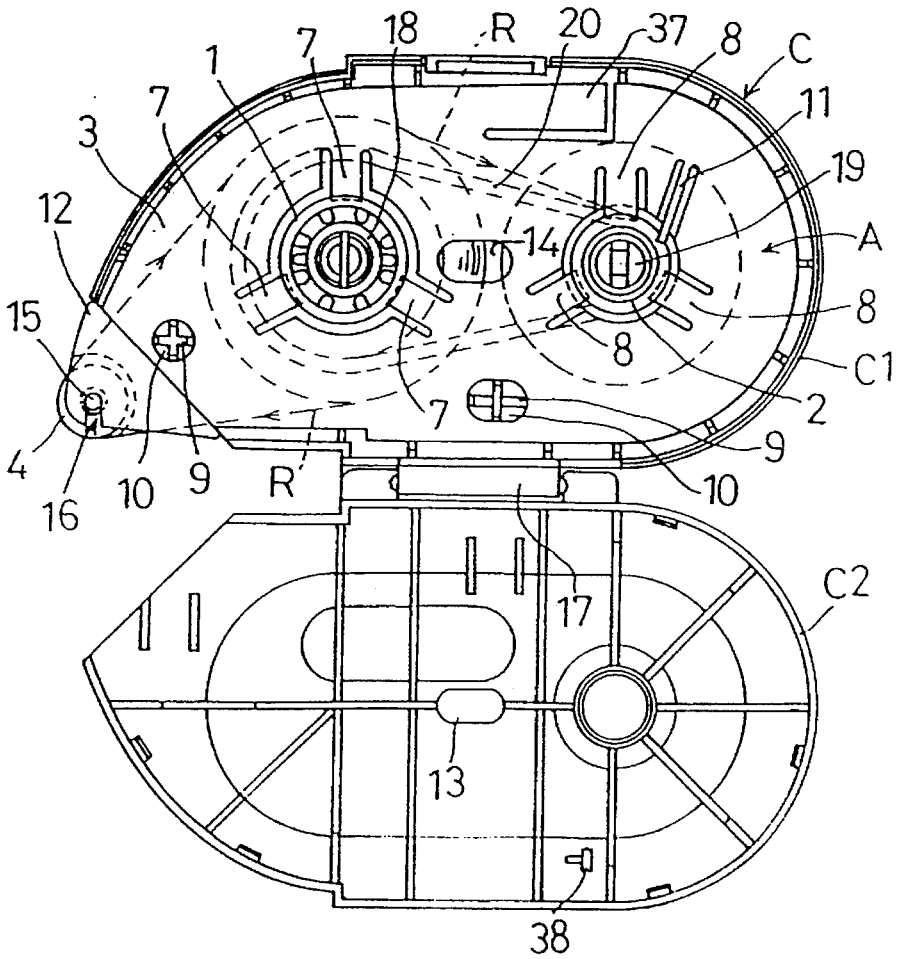
FIG. 2 is a plan view showing a mounted state of the transfer ribbon cassette of FIG. 1.

As shown in FIGS. 1 and 2, the holder 3 has an outer configuration generally following inner peripheries of the case C for enclosing the transfer ribbon cassette A. The holder 3 includes, as integral parts thereof, tongues 7 and 8 for rotatably supporting ends of the cores 1 and 2, perforations 10 for fitting on projections 9 formed on the case C to position the holder 3 relative to the case C, a pawl 11 placed in pressure contact with an inner surface of a peripheral groove 5 of the takeup core 2 to prevent backward rotation of the takeup core 2, second restrictors 12 in the form of a pair of right and left triangular plates for checking transverse displacement of the transfer ribbon R moving past the press roller 4. Further, the holder 3 defines a slot 14 for enabling observation, when the holder 3 is attached to the case C, through a window 13 defined in the case C, of an unused amount of the transfer ribbon R wound on the feed core 1.

Each of the cores 1 and 2 has a peripheral groove 5 defined adjacent one axial end thereof, and a first restrictor 6 in the form of a circular flange defined at the other axial end for checking displacement toward the other axial end of the transfer ribbon R wound around the core 1 or 2. One end of each core 1 or 2 is press fit to the holder 3 while elastically deforming the tongues 7 or 8 in the direction of thickness thereof. Then the tongues 7 or 8 are allowed to fit into the peripheral groove 5 to rotatably support the core 1 or 2 at one end thereof.

Each of the first restrictors 6 may be in the form of separate pieces extending radially outwardly of the core. The second restrictors 12 may be fixed to opposite ends (transversely of the ribbon) of a stationary transfer head.

The press roller 4 has pins 15 projecting from opposite ends thereof. The second restrictors 12 define pin receiving bores for supporting the pins 15, and cutout grooves 16 continuous with the pin receiving bores and slightly narrower than a diameter of the pins 15, respectively. The pins 15 are forcibly inserted from a radial direction along the cutout grooves 16 into the pin receiving bores, whereby the opposite ends of the press roller 4 are rotatably supported and retained by the fight and left second restrictors 12. An intermediate portion of the transfer ribbon R extending from the feed core 1 to the takeup core 2 is wound around the press roller 4.

Figure 3:
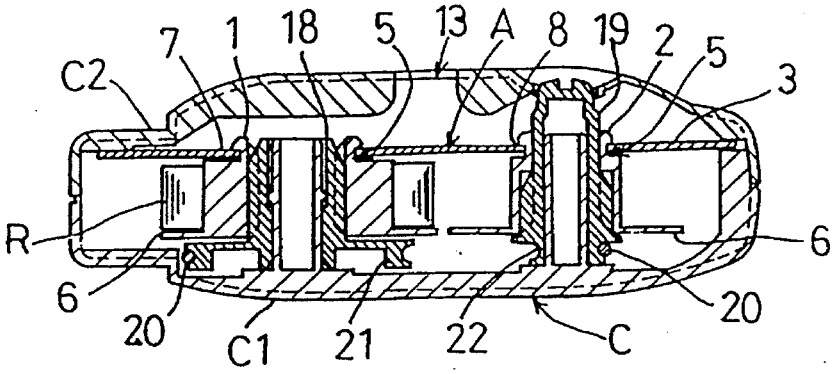
FIG. 3 is a sectional view showing a mounted state of a principal portion of the transfer ribbon cassette of FIG. 1.

FIGS. 2 and 3 show a paint film transfer device having the above transfer ribbon cassette A removably mounted in the case C. The case C includes two split case members C1 and C2 connected to each other transversely of the transfer ribbon R to be openable and closable through a hinge 17. One of the split case members C1 rotatably supports a feeding tubular shaft 18 for fitting in an axial bore of the feed core 1, and a takeup tubular shaft 19 for fitting in an axial bore of the takeup core 2. A slip interlock mechanism 39 is provided to interlock the feed core 1 and takeup core 2 such that the takeup core 2 fitted on the takeup tubular shaft 19 is rotatable faster than the feed core 1 fitted on the feeding tubular shaft 18, with slippage allowed between the rotation of the feed core 1 and rotation of the takeup core 2.

The slip interlock mechanism 39 includes a large diameter pulley 21 formed integral with one end of the feeding tubular shaft 18, a small diameter pulley 22 formed integral with one end of the takeup tubular shaft 19, and an endless transmission belt 20 formed of rubber and wound around the large diameter pulley 21 and small diameter pulley 22. The small diameter pulley 22 has a smaller diameter than the large diameter pulley 21 so that ribbon takeup speed of the takeup core 2 is faster than ribbon feed speed of the feed core 1 even when a winding diameter of the transfer ribbon R on the feed core 1 diminishes. Slippage between the transmission belt 20 and small diameter pulley 22 provides slippable interlocking between the rotation of the feed core 1 and rotation of the takeup core 2 to absorb a difference between the ribbon feed speed and ribbon takeup speed.

Figure 4:
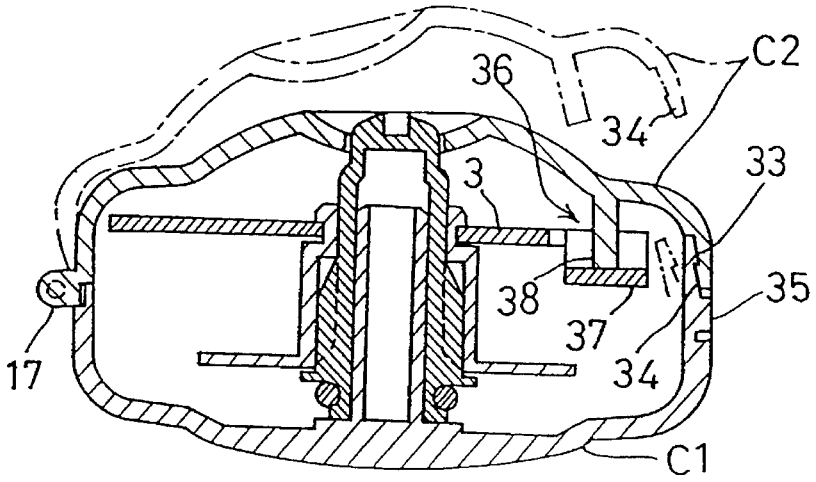
FIG. 4 is a sectional view showing opening and closing of a case enclosing the transfer ribbon cassette of FIG. 1.

As shown in FIG. 4, the split case members C1 and C2 include engaging craws 33 and 34 for engaging each other when the case members C1 and C2 are closed. When the case C is closed, the holder 3 is held between the two case members C1 and C2. In this state, chattering of the transfer ribbon cassette A is prevented. When a press portion 35 of the first case member C1 is pressed inward with a thumb or finger, the engaging craws 33 and 34 are disengaged to expose the transfer ribbon cassette A.

An opening mechanism 36 is provided between the transfer ribbon cassette A and case C. When the engaging craws 33 and 34 are disengaged by a pressure applied to the press portion 35, the opening mechanism 36 causes the split case members C1 and C2 to pivot relative to each other. Then, this mechanism 36 maintains the engaging craws 33 and 34 out of engagement after removal of the pressure from the press portion 35.

The opening mechanism 36 includes an elastic piece 37 formed to be elastically deformable in directions of thickness by means of an L-shaped groove cut in the holder 3. Further, a pressing projection 38 is formed integrally with an inner surface of the second split case member C2 for pressing the elastic piece 37 when the split case members C1 and C2 are closed with the transfer ribbon cassette A mounted in between. When the split case members C1 and C2 are closed and the engaging craws 33 and 34 engaged, the elastic piece 37 remains elastically deformed under pressure of the pressing projection 38. When the press portion 35 is pressed to disengage the engaging craws 33 and 34, the second case member C2 is pushed open by the elastic restoring force of the elastic piece 37. As a result, the two case members C1 and C2 pivot relative to each other to positions not to permit re-engagement of the engaging craws 33 and 34.

Figure 5:
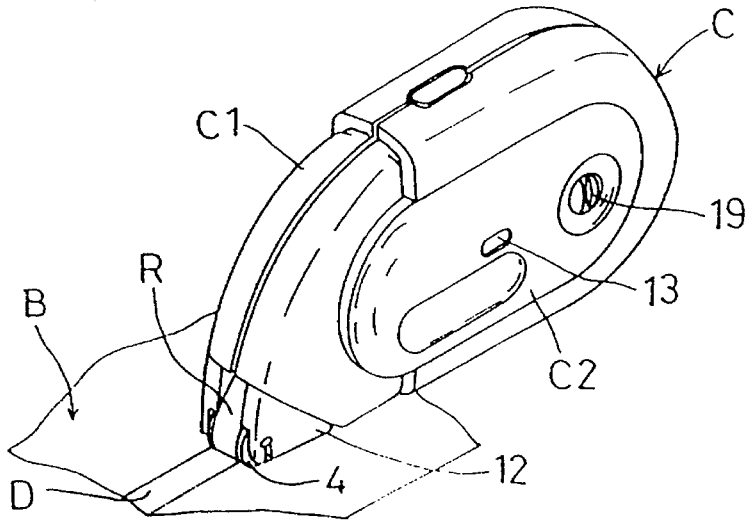
FIG. 5 is a perspective view showing use of the transfer ribbon cassette of FIG. 1.

With the case C opened, the projections 9 formed on one of the split case members C1 are fitted in the perforations 10 of the plate-like holder 3 to position the transfer ribbon cassette A relative to the case member C1. The transfer ribbon cassette A is attached to the case member C1 with the tubular shafts 18 and 19 fitted into free ends of the cores 1 and 2. The case C is closed with the other split case member C2. As shown in FIG. 5, the press roller 4 is moved upstream with respect to a direction of ribbon feeding from the feed core 1, while pressing the adhesive film D of the transfer ribbon R upon the receiving surface B. The transfer ribbon R becomes unwound while rotating the feed core 1, and the adhesive film D is transferred to the receiving surface B. A used portion of the transfer ribbon R is taken up on the takeup core 2 while making a light and cohesive contact with the adhesive film D of the transfer ribbon R wound on the feed core 1.

The transfer ribbon cassette A may be attached at the side of the holder 3 to the first split case member C1 supporting the feeding tubular shaft 18 and takeup tubular shaft 19. Then, the free ends of the cores 1 and 2 are rotatably supported by the second split case member C2 upon closure of the case C.

In the above embodiment, the holder 3 is held between the two split case members C1 and C2 when the case C is closed, to prevent chattering of the transfer ribbon cassette A. Alternatively, at least three projections may be formed integrally with the surface of the holder 3 facing away from the cores 1 and 2. When the case C is closed, the inner surface of the second split case member C2 will press on tip ends of these projections to prevent chattering of the transfer ribbon cassette A.

With this construction, the projections may be formed to have varied lengths for the holder 3 to hold cores of different lengths corresponding to transfer ribbons of different widths. Thus, the same case C may be used for transfer ribbons of different widths.

The transfer ribbon cassette A may have each of the cores 1 and 2 lightly bonded to the holder 3 to be supported at one end thereof.

The plate-like holder 3 may include reinforcing ribs formed along peripheral edges thereof.

Other embodiments will be described next.

Figure 6:
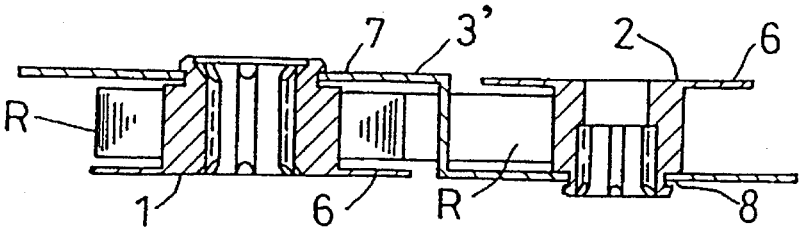
FIG. 6 is a sectional view of a principal portion of a transfer ribbon cassette in another embodiment of the invention.

(1) As shown in FIG. 6, a holder 3' Z-shaped as seen radially thereof may be used for rotatably supporting one end of each of the cores 1 and 2 arranged radially, the cores 1 and 2 being supported on a front surface and a back surface of the holder 3', respectively. Other aspects are the same as in the foregoing embodiment.

Figure 7:
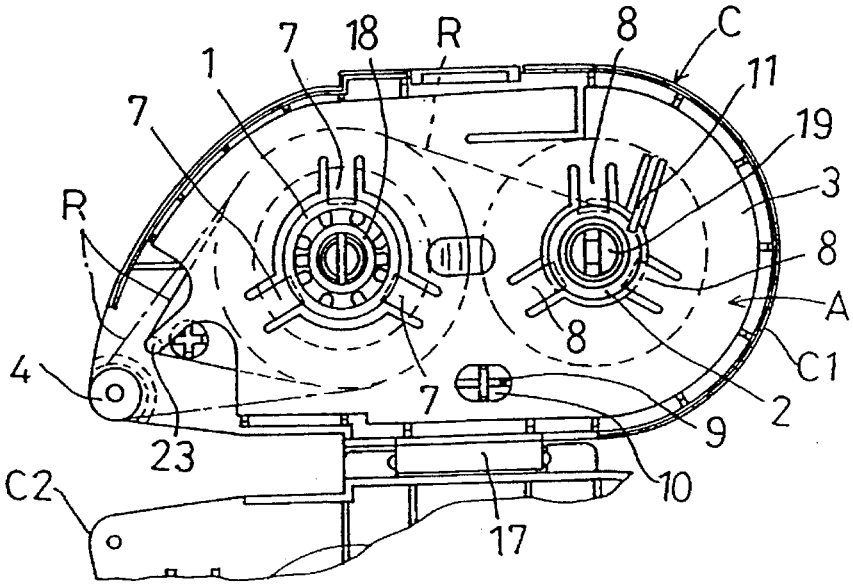
FIG. 7 is a plan view showing a mounted state of a transfer ribbon cassette in a further embodiment of the invention.

(2) FIG. 7 shows a transfer ribbon cassette A mounted in a case C having a transfer head 4 formed integral with a first split case member C1. The plate-like holder 3 has an engaging piece 23 formed integral therewith for engaging a portion of the transfer ribbon R extending from the feed core 1 to the takeup core 2. The transfer ribbon R is visible through the holder 3.

According to the transfer ribbon cassette A in this embodiment, after the transfer ribbon cassette A is attached to the case C with the free ends of the cores 1 and 2 fitted in the tubular shafts 18 and 19, the user may hold the portion of the transfer ribbon R extending from the feed core 1 to the takeup core 2 with his or her thumb and finger, and place that portion around the transfer head 4. Then, the transfer ribbon R extends along a ribbon guide path in the case C.

Figure 8:
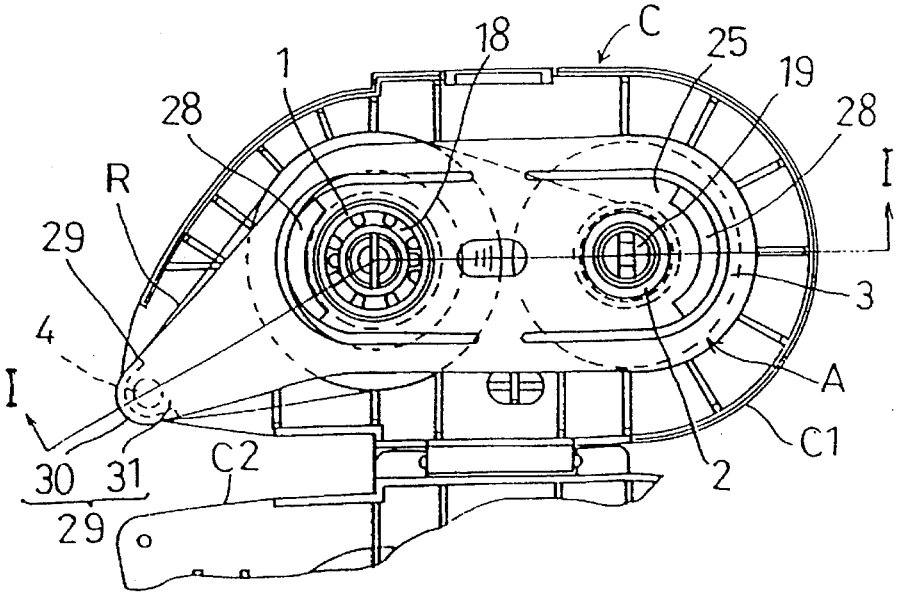
FIG. 8 is a plan view showing a mounted state of a transfer ribbon cassette in a still further embodiment of the invention.
Figure 9:
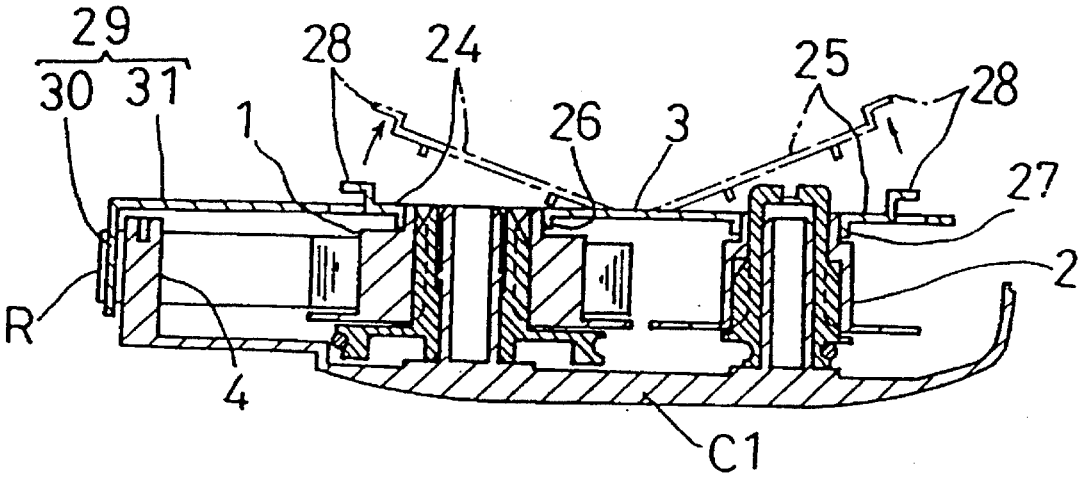
FIG. 9 is a action taken on line I—I of FIG. 8.

(3) FIGS. 8 and 9 show a transfer ribbon cassette A mounted in a case C having a transfer head 4 formed integral with a first split case member C1. A plate-like holder 3 supports one end of each of a feed core 1 and a takeup core 2 not to be rotatable. When the cores 1 and 2 are attached to the case C with free axial ends thereof fitted in tubular shafts 18 and 19, the free axial ends of the cores 1 and 2 are rotatably supported by the case C.

The holder 3 includes two tongues 24 and 25 defining approximately C-shaped grooves in plan view (FIG. 8), and tubular projections 26 formed integral with the tongues 24 and 25, respectively. The feed core 1 and takeup core 2 are press fit in the tubular projections 26 and 27 for support, respectively. When grips 28 formed at free ends of the tongues 24 and 25 are pulled up away from the cores 1 and 2 attached to the case C while pressing the main holder body toward the cores 1 and 2, the tubular projections 26 and 27 are separated from the cores 1 and 2. Then, the holder 3 may be detached from the cores 1 and 2.

The holder 3 includes a stretcher 29 formed integral therewith for stretching a portion of the transfer ribbon R extending from the feed core 1 to the takeup core 2 along a ribbon guide path in the case C. Thus, the stretcher 29 is detachable with the holder 3, leaving the cores 1 and 2 attached to the case C.

The stretcher 29 includes a curved engaging plate 30 around which the transfer ribbon R is wound, and an arm 31 for supporting the engaging plate 30 with a predetermined space therebetween.

Figure 10:
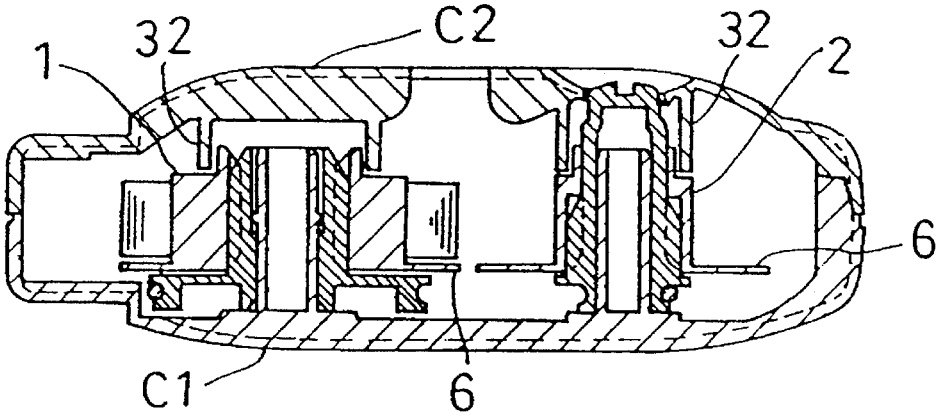
FIG. 10 is a sectional view of a principal portion of the transfer ribbon cassette in the embodiment of FIG. 8 showing a mounted state thereof.

As shown in FIG. 8, when the transfer ribbon cassette A is attached to the case C, the transfer ribbon R is guided close to the transfer head 4. When, in this state, the holder 3 is detached along with the stretcher 29 from the cores 1 and 2, the transfer ribbon R is placed substantially along the ribbon guide path in the case C. When the case C is closed with the second split case member C2, as shown in FIG. 10, axial displacement of the cores 1 and 2 is checked by tubular pressing members 32 formed integral with the second split case member C2.

(4) The large diameter pulley rotatable with the feed core may be formed separately from and assembled to the feed core. Similarly, the small diameter pulley rotatable with the takeup core may be formed separately from and assembled to the takeup core.

Figure 11:
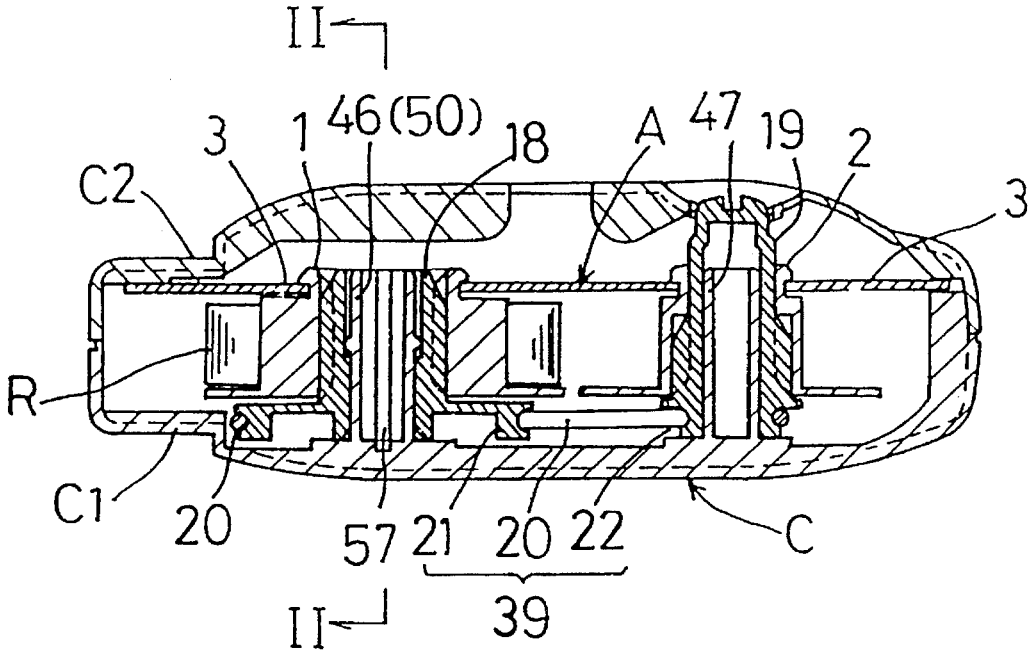
FIG. 11 is a sectional view of a paint film transfer device in a further embodiment of the invention.
Figure 12:
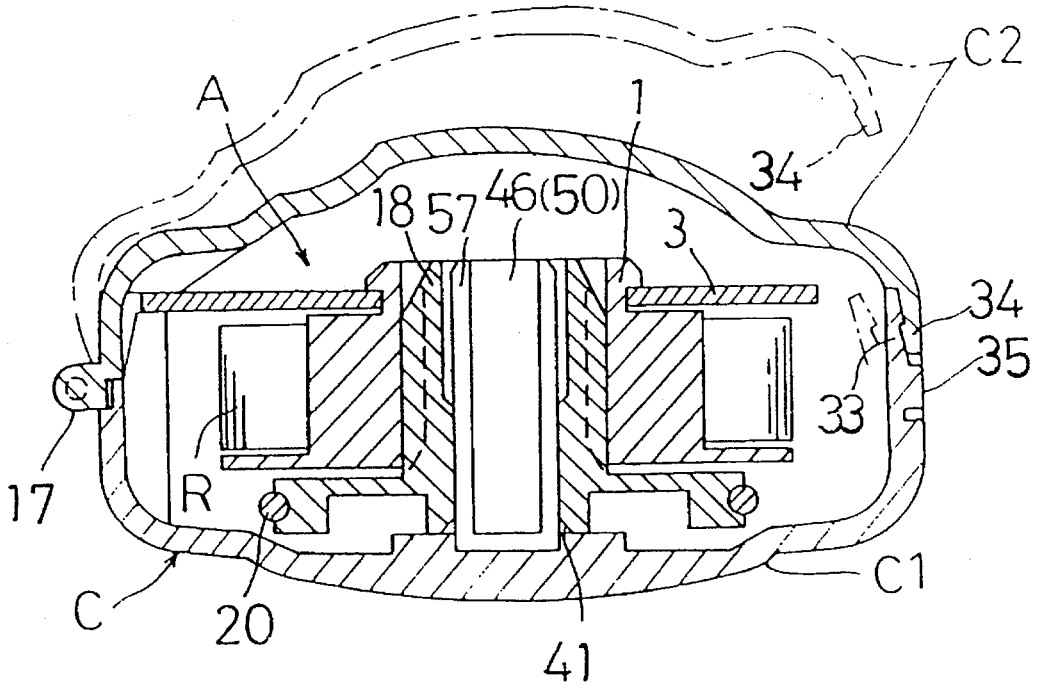
FIG. 12 is a section taken on line II—II of FIG. 11.

(5) FIGS. 11 and 12 show a different case C of the paint film transfer device.

The case C includes two split case members C1 and C2 connected to each other transversely of the transfer ribbon R to be openable and closable through a hinge 17. One of the split case members C1 has a first tubular support shaft 46 and a second tubular support shaft 47 formed integral with the case member C1. The feeding tubular shaft 18 is rotatably supported by the first support shaft 46. The takeup tubular shaft 19 is rotatably supported by the second support shaft 47.

The feed core 1 of the transfer ribbon cassette A is removably mounted on the feeding tubular shaft 18 to be rotatable therewith. The takeup core 2 of the transfer ribbon cassette A is removably mounted on the takeup tubular shaft 19 to be rotatable therewith.

A large diameter pulley 21 is formed integral with a proximal end of the feeding tubular shaft 18 adjacent the split case member C1. A small diameter pulley 22 is formed integral with a proximal end of the takeup tubular shaft 19 adjacent the split case member C1. A transmission belt 20 is wound around the large diameter pulley 21 and small diameter pulley 22. The belt 20 and pulleys 21 and 22 constitute a slip interlock mechanism 39 for rotating the feed core 1 and takeup core 2 with running of the transfer ribbon R.

When the press roller 4 is moved while pressing an adhesive film D of the transfer ribbon R upon a receiving surface B, the transfer ribbon R runs with the adhesive film D transferred to the receiving surface B. At this time, the transfer ribbon R rotates the feed core 1, and a used portion of the transfer ribbon R is taken up on the takeup core 2 also in rotation.

As shown in FIG. 12, the split case members C1 and C2 include engaging craws 33 and 34 for engaging each other when the case members C1 and C2 are closed. When the case C is closed, the holder 3 is held between the two case members C1 and C2 to prevent chattering of the transfer ribbon cassette A.

When a press portion 35 of the first case member C1 is pressed inward with a thumb or finger, the engaging craws 33 and 34 are disengaged to expose the transfer ribbon cassette A.

Figure 13:
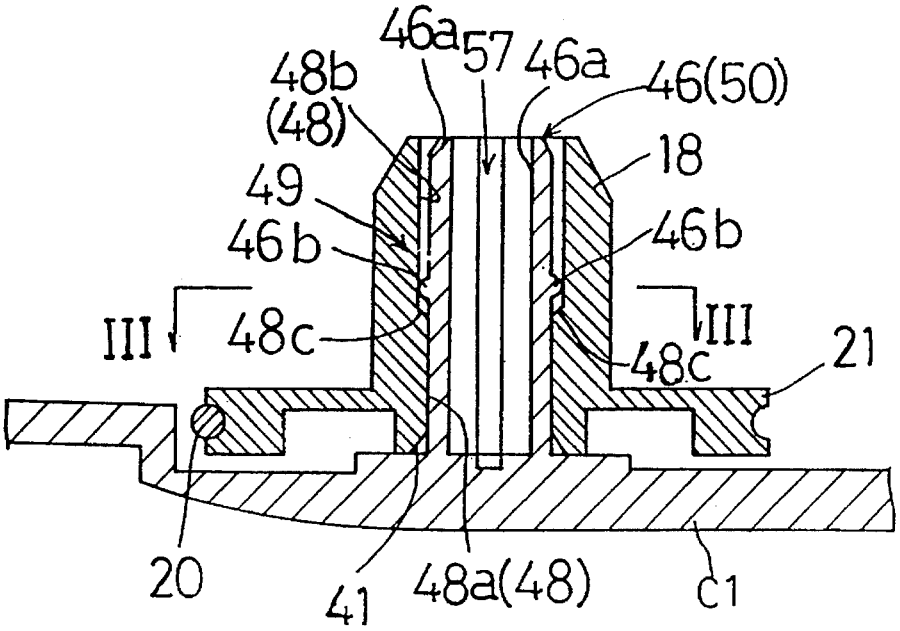
FIG. 13 is a sectional view of a principal portion of the paint film transfer device of FIG. 11, with a core removed.
Figure 14:
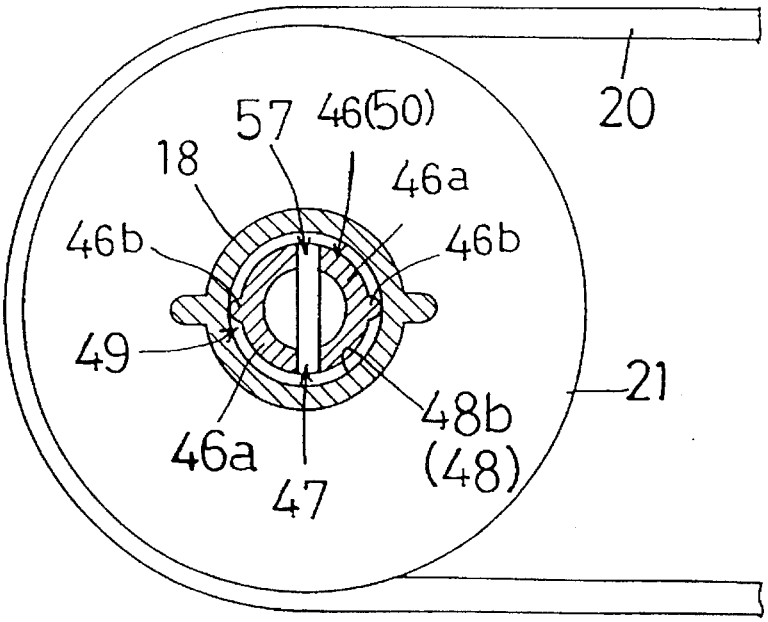
FIG. 14 is a section taken on line III—III of FIG. 13.
Figure 15:
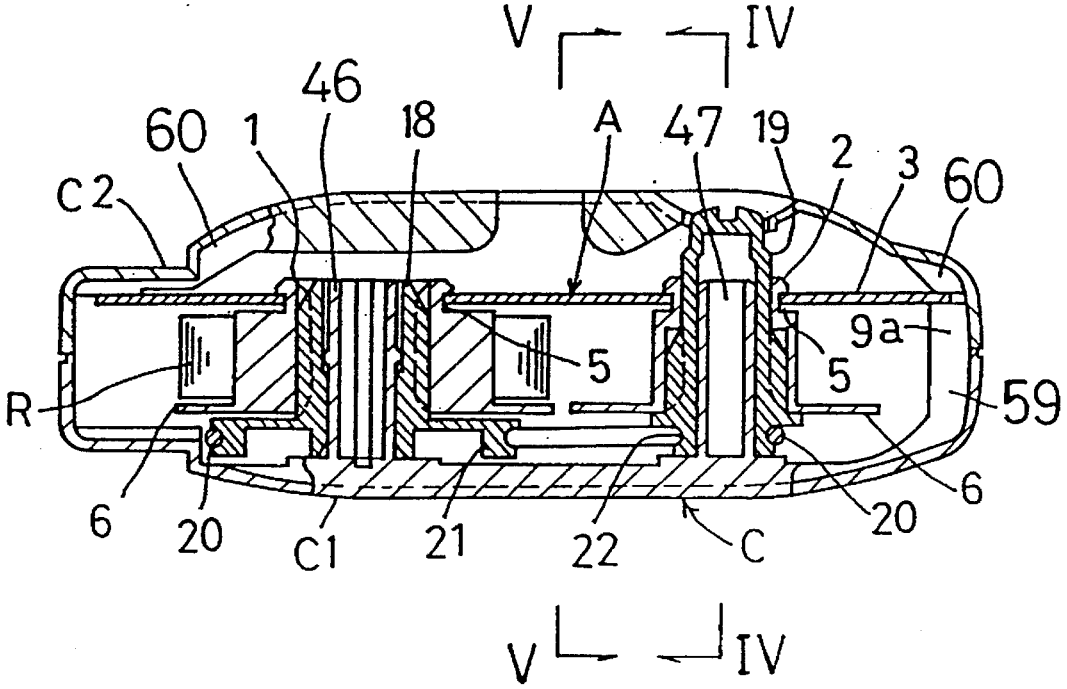
FIG. 15 is a sectional view of a paint film transfer device in a further embodiment of the invention.
Figure 16:
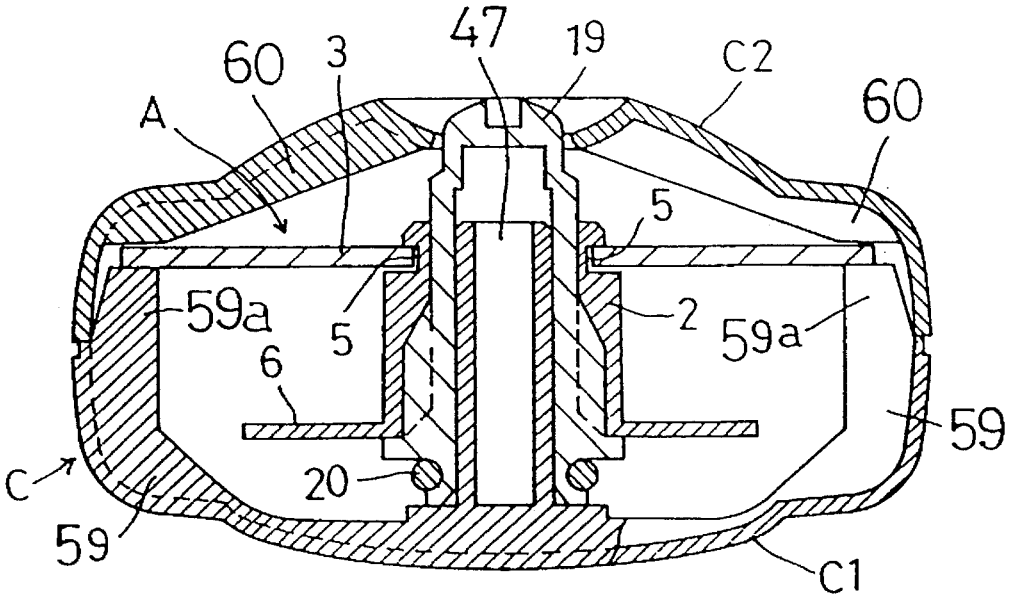
FIG. 16 is a section taken on line IV—IV of FIG. 15.

As shown in FIGS. 13 and 14, an engaging device 50 is formed between the first support shaft 46 and feeding tubular shaft 18 for engaging the first support shaft 46 with the feeding tubular shaft 18. The engaging device 50 is elastically movable to a disengaging position. The engaging device 50 provides a restrictor 49 for inhibiting the feeding tubular shaft 18 from moving out of the first support shaft 46.

The engaging device 50 includes slit-like cutouts 57 formed in two positions of the first support shaft 46 opposed to each other across an axis thereof and extending axially of the first support shaft 46, and projections **46*b* formed peripherally of a pair of shaft portions 46*a* divided by the two cutouts 57. The projections 46*b* are situated in axially intermediate positions at the same distance from a tip end of the first support shaft 46. The disengaging position noted above is provided by elastically tilting deformation toward the axis of the shaft portions 46*a***.

The feeding tubular shaft 18 defines a bore 48 for receiving the first support shaft 46. The bore 48 includes a small diameter portion **48*a* opposed to the split case member C1, and a large diameter portion 48*b* opposed to the plate-like holder 3. The feeding tubular shaft 18 includes a shoulder 48 in an axially intermediate position thereof. A pressing surface 41 is formed in the small diameter portion 48*a* for moving the engaging device 50 to the disengaging position when the feeding tubular shaft 18 is pushed onto the first support shaft 46**.

The feeding tubular shaft 18 supported by the first support shaft 46 is inhibited from moving out of the first support shaft 46 by engagement between the two projections **46*b* of the first support shaft 46 and the shoulder 48*c* of the feeding tubular shaft 18**.

Specifically, the small diameter portion **48*a* of the feeding tubular shaft 18 is fitted on the tip end of the first support shaft 46. In this state, the feeding tubular shaft 18 is pushed toward the split case member C1. Then, the pressing surface 41 contacts the projections 46*b*. As the feeding tubular shaft 18 is pushed further, the shaft portions 46*a* is pressed by the pressing surface 41 to tilt toward the axis. The projections 46*b* elastically move to the disengaging position, and enter the small diameter portion 48*a*. When the shoulder 48*c* of the feed tubular shaft 18 moves past the projections 46*b*, the shaft portions 46*a* elastically return away from the axis to engage the projections 46*b* with the shoulder 48*c***.

In this state, the feeding tubular shaft 18 is inhibited from moving out of the first support shaft 46, while being rotatably supported by the first support shaft 46.

The transfer ribbon may have a transfer paint film for use in correcting characters or a colored paint film for ornamental use. The transfer film is not limited to a particular type, function or use.

The support shaft may have a flanged plug or the like fitted or screwed into the tip end thereof. The flange will then act as a restrictor for contacting the tubular shaft to prevent the tubular shaft from moving out of the support shaft.

The restrictor may have an engaging device formed on the tubular shaft.

The interlock mechanism may be a gear type mechanism.

The second support shaft and takeup tubular shaft may have a restrictor for inhibiting the takeup tubular shaft from moving out of the second support shaft.

The projections formed on the shaft portions of the first support shaft may extend circumferentially of the shaft portions.

(6) A further embodiment will be described.

Figure 18:
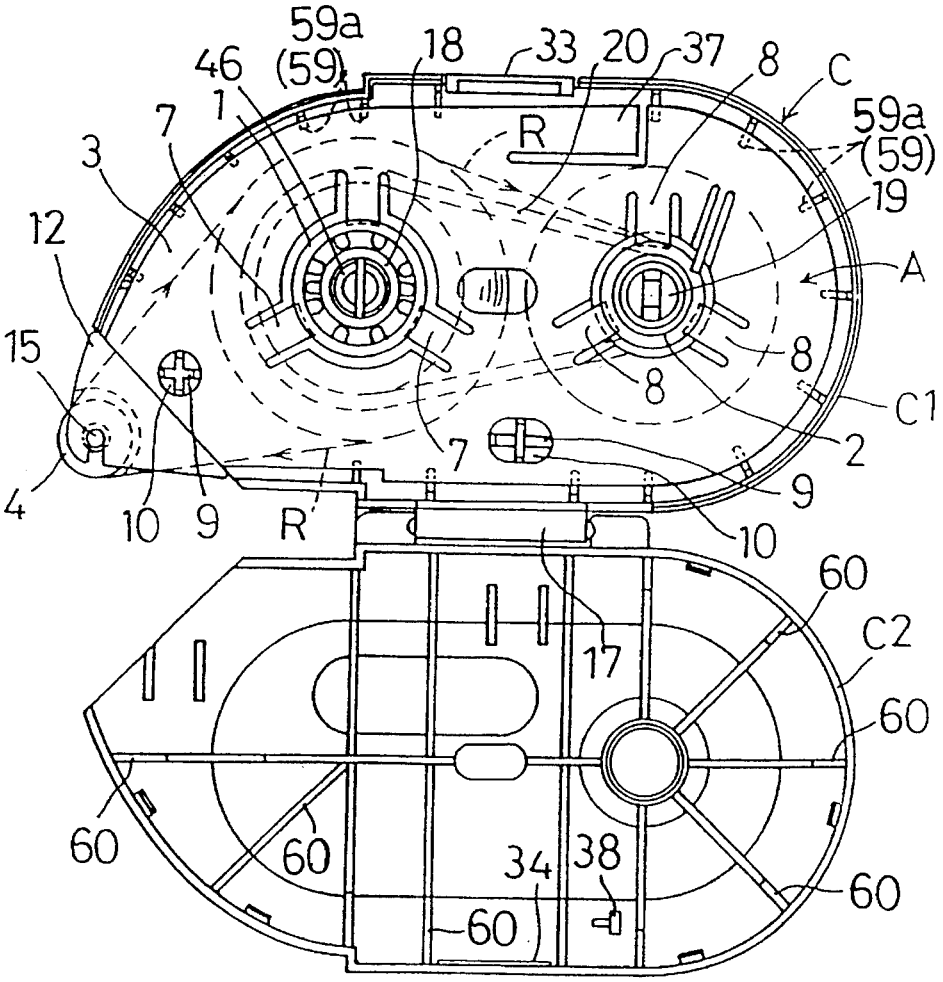
FIG. 18 is a plan view showing an open state of split case members shown in FIG. 15.
Figure 19:
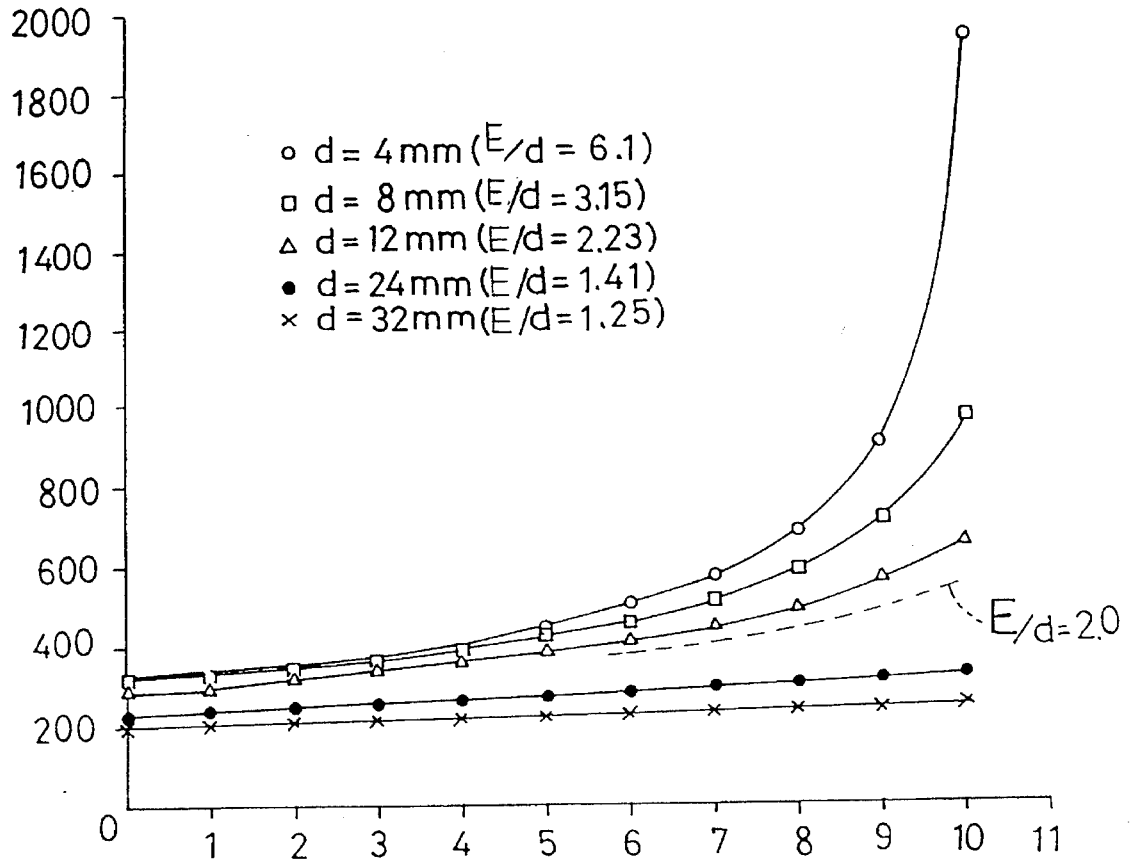
FIG. 19 is a graph showing results of calculations made of a relationship between tension and feeding length of a transfer ribbon of a paint film transfer device in a further embodiment of the invention.
Figure 20:
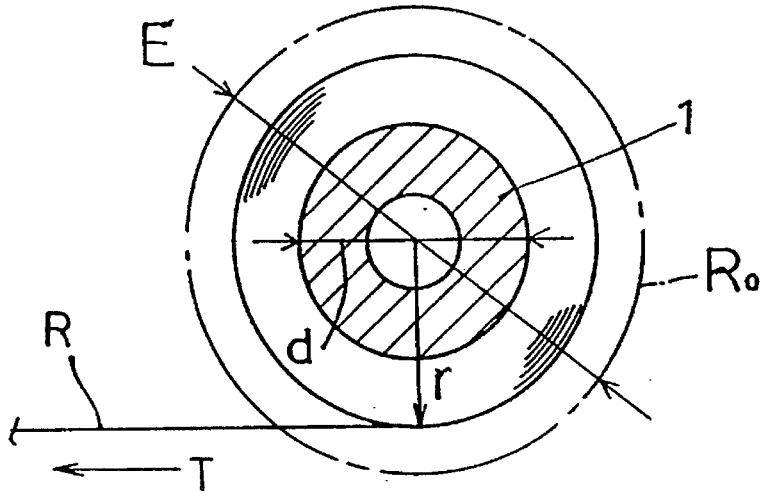
FIG. 20 is a schematic view showing a calculating method.
Figure 21:
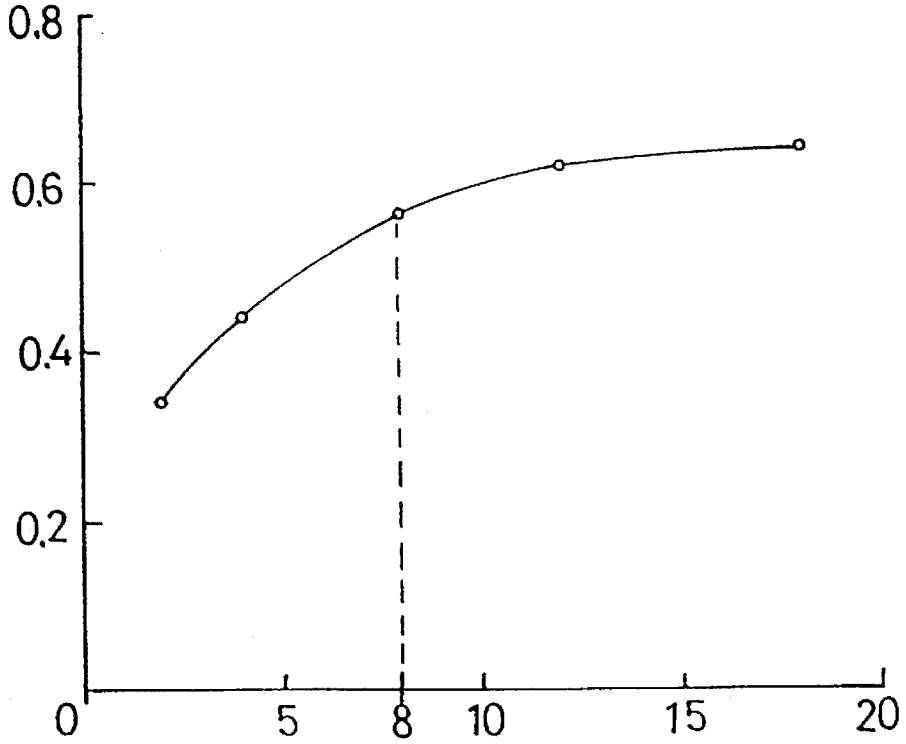
FIG. 21 is a graph showing results of experiment conducted for coefficient of dynamic friction and transfer roller diameter of the transfer device of FIG. 19.
Figure 22:
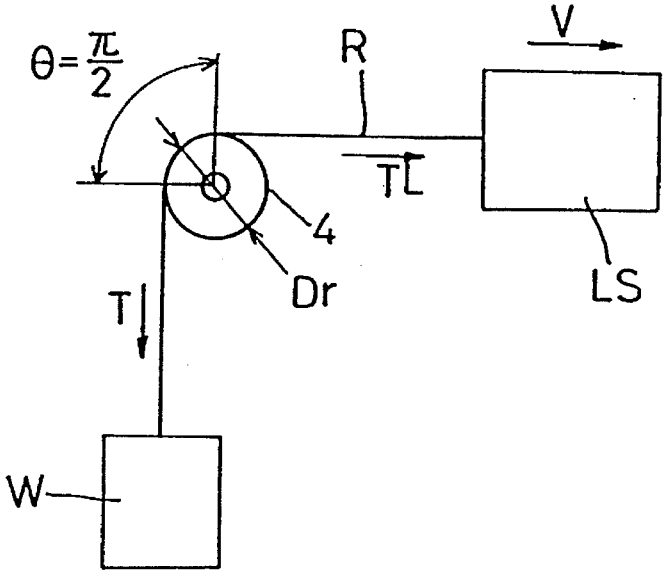
FIG. 22 is a schematic view illustrating the experiment of FIG. 21.
Figure 23:
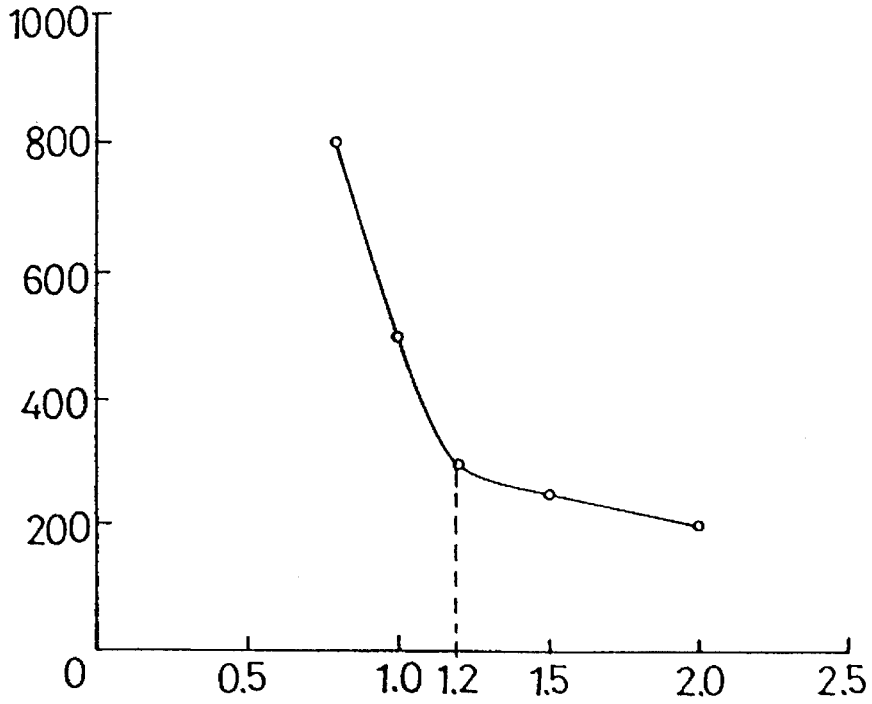
FIG. 23 is a graph showing results of experiment conducted for required minimum pressing force and transfer roller width/transfer ribbon width in the transfer device of FIG. 19.
Figure 24:
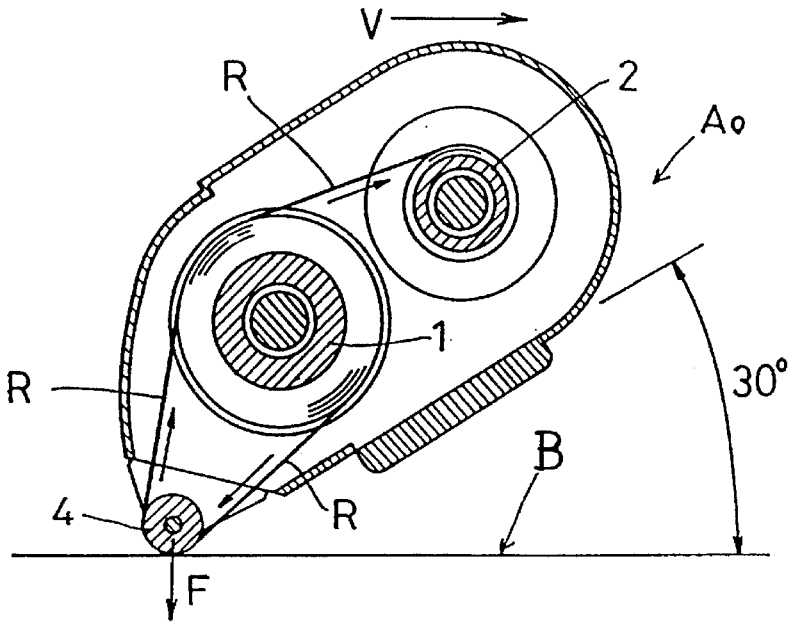
FIG. 24 is a schematic view illustrating the experiment of FIG. 23.

As shown in FIG. 18, a holder 3 has an outer configuration generally following inner peripheries of a case C. The holder 3 includes tongues 7 and 8 for rotatably supporting ends of cores 1 and 2. The holder 3 further includes, as integral parts thereof, perforations 10 for fitting on projections 9 formed on the case C to position the holder 3 relative to the case C, and second restrictors 12 in the form of a pair of fight and left triangular plates for checking transverse displacement of a transfer ribbon R moving past a press roller 4.

As shown in FIGS. 15 through 18, each of the cores 1 and 2 has a peripheral groove 5 defined adjacent one axial end thereof, and a first restrictor 6 in the form of a circular flange defined at the other axial end for checking displacement toward the other axial end of the transfer ribbon R wound around the core 1 or 2. When assembling to the plate-like holder 3, one end of each core 1 or 2 is press fit to the holder 3 while elastically deforming the tongues 7 or 8 in the direction of thickness thereof. Then the tongues 7 or 8 are allowed to fit into the peripheral groove 5 to rotatably support the core 1 or 2 at one end thereof.

The press roller 4 has pins 15 projecting from opposite ends thereof and rotatably supported by the second restrictors 12. An intermediate portion of the transfer ribbon R extending from the feed core 1 to the takeup core 2 is wound around the press roller 4.

The case C, in which the transfer ribbon cassette A having the above construction is removably mounted, includes split case members C1 and C2 connected to each other transversely of the transfer ribbon R to be openable and closable through a hinge 17. The first split case member C1 includes a first support shaft 46 for rotatably supporting a feeding tubular shaft 18 for fitting in an axial bore of the feed core 1, and a second support shaft 47 for rotatably supporting a takeup tubular shaft 19 for fitting in an axial bore of the takeup core 2. A transmission belt 20 is wound around the feeding tubular shaft 18 and takeup tubular shaft 19.

The transmission belt 20 interlocks the feed core 1 engaged with the feeding tubular shaft 18 and the takeup core 2 engaged with the takeup tubular shaft 19. As the transfer ribbon R is drawn to rotate the feed core 1, a used portion of the transfer ribbon R is taken up on the takeup core 2.

The split case members C1 and C2 include reinforcing ribs 59 and 60 formed integral with and projecting from inner peripheral surfaces thereof inwardly of the case C. When the case C is closed, the reinforcing ribs 59 of the first case member C1 extend into the second case member C2. Peripheries of the plate-like holder 3 lie between the reinforcing ribs 59 and 60, to check movement of the holder 3 in directions of its thickness.

Specifically, when the case C is closed, gaps slightly larger than a thickness of the plate-like holder 3 are formed between opposed end surfaces of extensions 59*a* of the reinforcing ribs 59 formed on the first case member C1 and the reinforcing ribs 60 formed on the second case member C2. The end surfaces of the reinforcing ribs 59 and 60 opposed to each other in the direction of thickness of the plate-like holder 3 act as restrictor surfaces for checking movement of the plate-like holder 3 in the directions of its thickness.

The extensions 59*a* of the reinforcing ribs 59 contact inner peripheral edges of the second case member C2 when the two case members C1 and C2 are closed, to check relative displacement between the case members C1 and C2 in directions of thickness of the transfer ribbon R.

Figure 17:
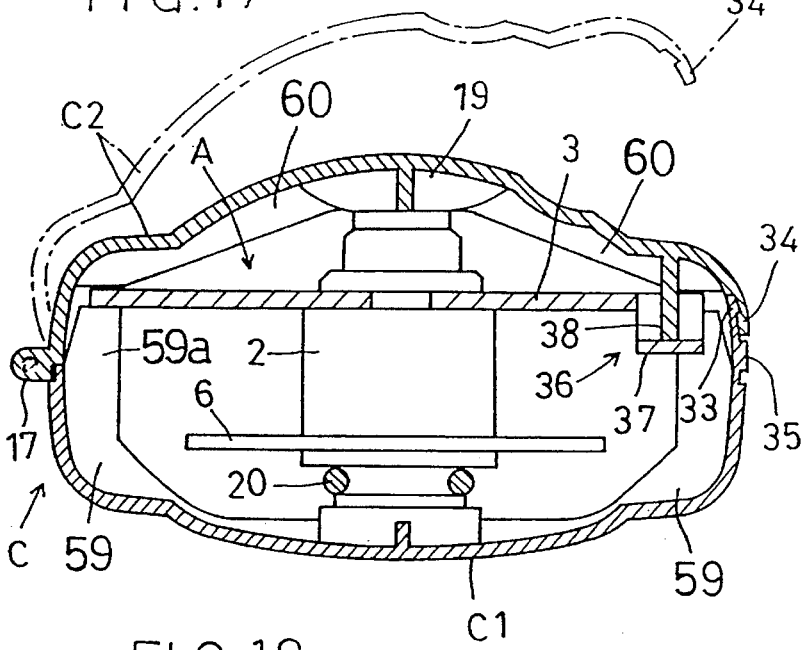
FIG. 17 is a section taken on line V—V of FIG. 15.

As shown in FIG. 17, the first split case member C1 includes an engaging craw 33 while the second split case member C2 includes an engaging craw 34. When the two case members C1 and C2 are closed, the engaging craw 33 engages the engaging craw 34 to maintain the two case members C1 and C2 closed.

When a press portion 35 of the first case member C1 is pressed inward with a thumb or finger, the engaging craws 33 and 34 are disengaged to open the case C.

An opening mechanism 36 is provided between the transfer ribbon cassette A and case C. When the engaging craws 33 and 34 are disengaged by a pressure applied to the press portion 35, the opening mechanism 36, by means of its elastic force, opens the split case members C1 and C2.

The opening mechanism 36 includes an elastic piece 37 formed to be elastically deformable in the directions of thickness by means of an L-shaped groove cut in the plate-like holder 3. Further, a pressing projection 38 is formed integrally with an inner surface of the second split case member C2 for pressing the elastic piece 37 when the split case members C1 and C2 are closed with the transfer ribbon cassette A mounted in between.

When the split case members C1 and C2 are closed and the engaging craws 33 and 34 engaged, the elastic piece 37 remains elastically deformed under pressure of the pressing projection 38. When the press portion 35 is pressed to disengage the engaging craws 33 and 34, the second case member C2 is pushed open by the elastic restoring force of the elastic piece. As a result, the two case members C1 and C2 pivot relative to each other to positions not to permit re-engagement of the engaging craws 33 and 34.

With the case C opened, the projections 9 formed on the first split case members C1 are fitted in the perforations 10 of the plate-like holder 3 to position the transfer ribbon cassette A relative to the case member C1. The transfer ribbon cassette A is attached to the case C with the tubular shafts 18 and 19 fitted into free ends of the cores 1 and 2.

In this state, the free axial ends of the cores 1 and 2 are rotatably supported by the case C through the tubular shafts 18 and 19 and support shafts 46 and 47, respectively.

After the case C is closed, the press roller 4 may be moved while pressing the adhesive film D of the transfer ribbon R upon a receiving surface B. Then, the transfer ribbon R becomes unwound while rotating the feed core 1, and the adhesive film D is transferred to the receiving surface B. A used portion of the transfer ribbon R is taken up on the takeup core 2.

The transfer ribbon cassette A may be mounted in a case C consisting of split case members C1 and C2 with no reinforcing ribs. In this case, the two split case members C1 and C2 may include a restrictor formed on inner surfaces thereof exclusively for checking movement of the plate-like holder 3 in the directions of its thickness.

Even where the split case members C1 and C2 have the reinforcing ribs 59 and 60, a restrictor may be provided separately from the reinforcing ribs 59 and 60 and exclusively for the purpose of checking movement of the plate-like holder 3 in the directions of its thickness. Further, the plate-like holder 3 may be prevented from moving in the directions of its thickness by the reinforcing ribs of the first split case member and a special restrictor provided on the second split case member.

The transfer ribbon cassette may have a transfer ribbon with a transfer paint film for use in correcting characters or a colored paint film for ornamental use. The transfer film is not limited to a particular type, function or use.

(7) A further embodiment will be described.

A paint film transfer device in this embodiment includes an unused transfer ribbon R having a total length of about 10m wound as transfer ribbon winding R0 on a feed core 1. The transfer ribbon winding R0 of a substantially entire length of the transfer ribbon R has an outside diameter E in the ratio (E/d) not exceeding 2.2 (1.4 in this embodiment) with respect to an outside diameter "d" of the feed core 1. A press roller 4 has an outside diameter Dr in the range of 8 mm to 20 mm (9 mm in the embodiment), with an outer peripheral surface having a spring hardness Hs (JISA) set to about 60 degrees. Further, the press roller 4 has a peripheral roller width Kr in the ratio (kr/K) of 1.2 to 2.5 (1.5 in the embodiment) with respect to width K of the transfer ribbon R.

A holder 3 has an outer configuration generally following inner peripheries of a case C to which the holder 3 is attached, and rotatably supports ends of cores 1 and 2. The holder 3 further includes, as integral parts thereof, perforations 10 for fitting on projections 9 formed on the case C to position the holder 3 relative to the case C, a pawl 11 for preventing backward rotation of the takeup core 2, and second restrictors 12 in the form of a pair of fight and left triangular plates for checking transverse displacement of the transfer ribbon R moving past the press roller 4.

The press roller 4 has opposite ends thereof transversely of the transfer ribbon R rotatably supported by the second restrictors 12. A portion of the transfer ribbon R extending from the feed core 1 to the takeup core 2 is wound around the press roller 4.

Figure 26:
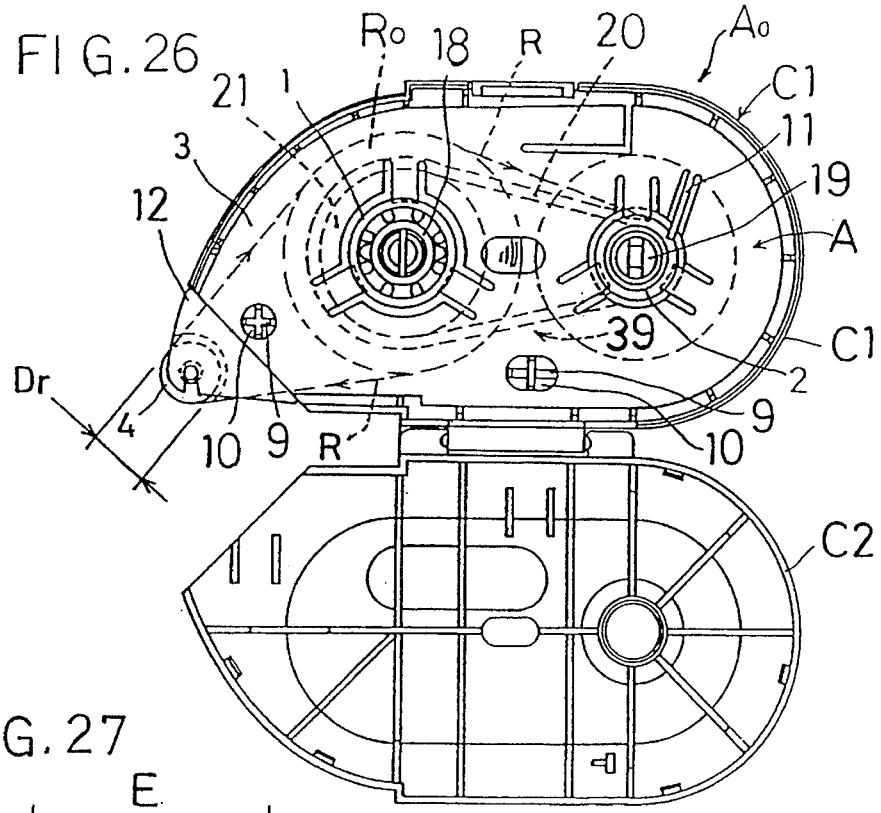
FIG. 26 is a plan view showing interior of the transfer device of FIG. 19.
Figure 27:
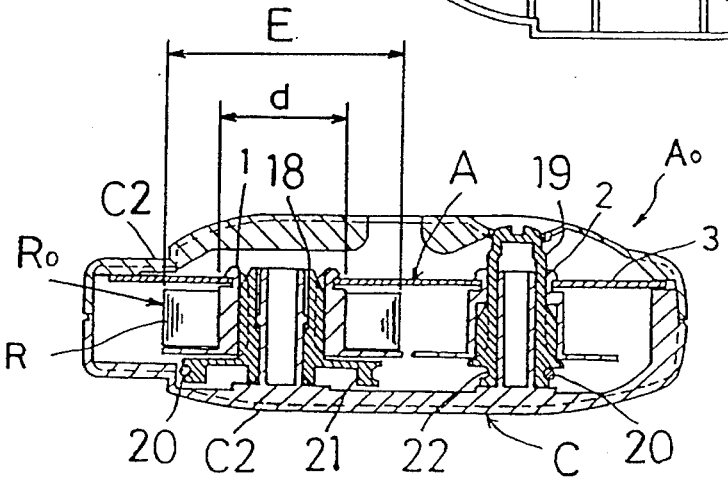
FIG. 27 is a sectional view of a principal portion of the transfer device of FIG. 19.
Figure 28:
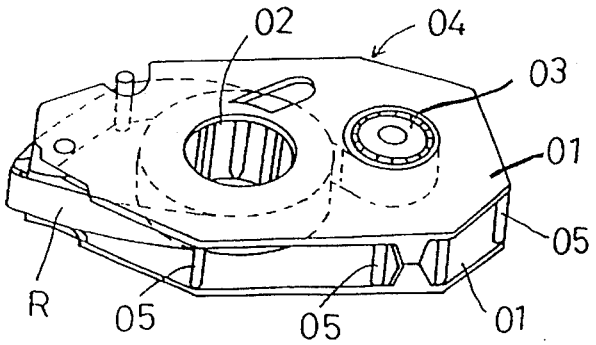
FIG. 28 (PRIOR ART)
FIG. 28 is a perspective view of a prior art example.

FIGS. 26 and 27 show a paint film transfer device A0 having the above transfer ribbon cassette A removably mounted in the case C. The case C includes two split case members C1 and C2 connected to each other transversely of the transfer ribbon R to be openable and closable. The first split case member C1 rotatably supports a feeding tubular shaft 18 for fitting in an axial bore of the feed core 1, and a takeup tubular shaft 19 for fitting in an axial bore of the takeup core 2. A slip interlock mechanism 39 is provided to interlock the feed core 1 and takeup core 2 such that the takeup core 2 fitted on the takeup tubular shaft 19 is rotatable faster than the feed core 1 fitted on the feeding tubular shaft 18, with slippage allowed between the rotation of the feed core 1 and rotation of the takeup core 2.

The slip interlock mechanism 39 includes a large diameter pulley 21 formed integral with one end of the feeding tubular shaft 18, a small diameter pulley 22 formed integral with one end of the takeup tubular shaft 19, and an endless transmission belt 20 formed of rubber and wound around the large diameter pulley 21 and small diameter pulley 22. The small diameter pulley 22 has a smaller diameter than the large diameter pulley 21 so that ribbon takeup speed of the takeup core 2 is faster than ribbon feed speed of the feed core 1 even when the outside diameter E of the transfer ribbon winding R0 on the feed core 1 diminishes with use of the transfer ribbon R. Slippage between the transmission belt 20 and small diameter pulley 22 provides slippable interlocking between the rotation of the feed core 1 and rotation of the takeup core 2 to absorb a difference between the ribbon feed speed and ribbon takeup speed.

Setting is made in advance so that slippage occurs between the transmission belt 20 and small diameter pulley 22 when the feed core 1 is subjected to a torque M0 of about 390gf. cm or more.

Figure 25:
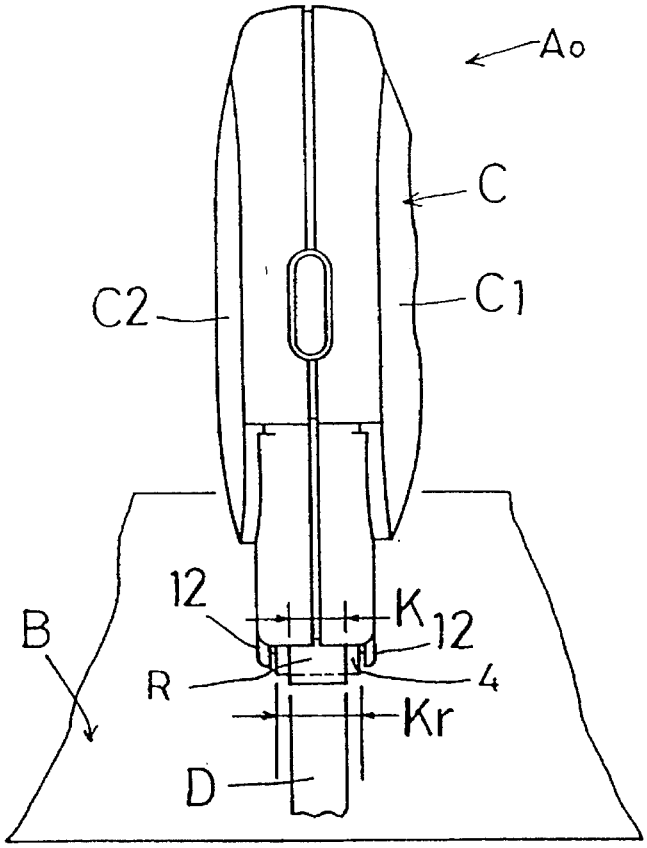
FIG. 25 is a perspective front view of the transfer device of FIG. 19.

With the case C opened, the projections 9 formed on the first split case member C1 are fitted in the perforations 10 of the plate-like holder 3 to position the transfer ribbon cassette A relative to the case member C1. The transfer ribbon cassette A is attached to the case member C1 with the tubular shafts 18 and 19 fitted into free ends of the cores 1 and 2. The case C is closed with the second split case member C2. As shown in FIG. 25, the press roller 4 is moved upstream with respect to a direction of ribbon feeding from the feed core 1, while pressing an adhesive film D of the transfer ribbon R upon the receiving surface B. The transfer ribbon R becomes unwound while rotating the feed core 1, and the adhesive film D is transferred to the receiving surface B. A used portion of the transfer ribbon R is taken up on the takeup core 2 while making a light and cohesive contact with the adhesive film D of the transfer ribbon R wound on the feed core 1.

(8) The paint film transfer device may be used for transferring to a receiving surface a transfer film for correcting characters or a colored paint film for ornamental use. Further, the transfer device may be used for transferring a heat sensitive transfer film as well as a pressure sensitive transfer film. The transfer film is not limited to a particular type, function or use.

What is claimed is:

1. A transfer ribbon cartridge formed separately from a case and adapted to be enclosed in said case, said transfer ribbon cartridge comprising:

transfer ribbon;

a feed core for winding a transfer ribbon having a transfer film applied to one surface thereof, one end of a peripheral surface of said feed core having a first group;

a takeup core for taking up said transfer ribbon fed from said feed core, one end of a peripheral surface of said takeup core having a second groove;

a holder detachably held in said case, said holder having first and second engaging holes engaging with said feed core and said takeup core, respectively, said holder further including a first tongue extending in said first engaging hole for elastically engaging said first groove of said feed core, and a second tongue extending in said second engaging hole for elastically engaging said second groove of said takeup core whereby said feed core and said takeup core are rotatably supported by said holder at one end thereof; and a transfer head provided in said holder for pressing said transfer ribbon upon a receiving surface to transfer said transfer film to said receiving surface.

wherein each of said feed core and said takeup core, when mounted in said case, has a free axial end thereof supported by said case.

2. A transfer ribbon cartridge as defined in claim 1, wherein each of said feed core and said takeup core has first restrictor means defined at said free axial end thereof for checking displacement of said transfer ribbon toward said free axial end.

3. A transfer ribbon cartridge as defined in claim 1, further comprising a second restrictor means for checking transverse displacement of said transfer ribbon moving past said transfer head.

4. A transfer ribbon cartridge as defined in claim 1, wherein said holder rotatably supports one end of each of said feed core and said takeup core, such that a portion of said transfer ribbon extending from said feed core to said takeup core is visible through said holder.

5. A transfer ribbon cartridge as defined in claim 1, wherein said holder is Z-shaped as seen radially thereof for rotatably supporting one end of each said feed core and said takeup core arranged radially, said feed core and said takeup core being supported on a front surface and a back surface of said holder, respectively.

6. A transfer ribbon cartridge as set forth in claim 3, wherein said second restrictor means is formed of resin integrally with said holder and supports opposite ends of said transfer head transversely of said transfer ribbon.

7. A transfer ribbon cartridge formed separately from a case and adapted to be enclosed in said case, said transfer ribbon cartridge comprising:

a feed core for winding a transfer ribbon having a transfer film applied to one surface thereof;

a takeup core for taking up said transfer ribbon fed from said feed core;

a holder for holding said feed core and said takeup core in a relative positional relationship for mounting in a case; and means provided in said holder for allowing said feed core and said takeup core to be detached from said holder whereby said feed core and said takeup core are mounted simultaneously in said case with said holder detached from said cores, wherein each of said feed core and said takeup core is rotatably supported at one end thereof and, when mounted in said case, has a free axial end thereof supported by said case, said holder being removable from said feed core and said takeup core.

8. A transfer ribbon cartridge as defined in claim 7, wherein said holder includes stretcher means formed integral therewith for stretching a portion of said transfer ribbon extending from said feed core to said takeup core along a ribbon guide path in said case, said stretcher means including a curved engaging plate around which said transfer ribbon is wound, and an arm for supporting said engaging plate at a predetermined space therebetween.

9. A transfer ribbon cartridge as set forth in claim 7, wherein said means for allowing feed core and said takeup core to be detached from said holder includes:

a first tubular projection for retaining said feed core;

a second tubular projection for retaining said takeup core; and a first piece and a second piece having said first and second tubular projections, respectively, and movable in a direction opposite said free axial ends of said cores whereby said feed core and said takeup core are removed from said first and said second tubular projections, respectively, by moving said first and second pieces in said direction opposite said free axial ends with said cores attached to said case.

10. A case comprising:

a transfer ribbon cartridge;

a first split case member for supporting the transfer ribbon cartridge;

a second split case member for enclosing said transfer ribbon cartridge in combination with said first split case member;

a hinge member connecting an edge of said first split case member with a corresponding edge of said second split member for allowing a closed position and an open position of said first and second split case members;

an elastic member formed on one of said first split case member and said second split case member to be elastically deformable with closing of said split case members, said elastic member applying an urging force toward said open position; and engaging means for maintaining said split case members in said closed position.

11. A case as defined in claim 10, further including a transfer ribbon, wherein said first split case member includes a transfer head for pressing a transfer ribbon upon a receiving surface to press an adhesive surface of said transfer ribbon upon said receiving surface.

12. A paint film transfer device comprising:

a case including a first split case member having a stationary shaft and a second split case member; and a transfer ribbon cartridge containing:

a transfer ribbon:

a feed core;

a takeup core combined with said feed core for winding a transfer ribbon having a transfer film applied to one surface thereof;

a holder for holding said feed core and said takeup core in a relative positional relationship for mounting in said case;

a tubular shaft formed separately from said feed core and located between said feed core and said stationary shaft for removably supporting said feed core to be rotatable therewith;

a slip interlock mechanism for rotating said tubular shaft with running of said transfer ribbon; and restrictor means formed between said support shaft and said tubular shaft for inhibiting said tubular shaft from moving out of said support shaft, wherein said restrictor means includes engaging means for engaging said support shaft with said tubular shafts, said engaging means being elastically movable to a disengaging position, and a pressing surface for moving said engaging means to said disengaging position during an operation to fit said tubular shaft on said support shaft.

13. A paint film transfer device comprising:

a feed core for winding a transfer ribbon to form transfer ribbon winding;

a transfer head;

a transfer roller rotatably supported to said transfer head movable upstream with respect to the direction of ribbon feeding from said feed core while pressing a transfer surface of said transfer ribbon upon said receiving surface, said transfer roller having an outside diameter of 8 mm to 20 mm:

a takeup core for taking up said transfer ribbon having passed through said transfer head; and a slip interlock mechanism for interlocking said feed core and said takeup core such that said takeup core is rotatable faster than said feed core, with slippage allowed between rotation of said feed core and rotation of said takeup core;

said transfer ribbon becoming unwound while rotating said feed core, with a used portion of said transfer ribbon having passed through said transfer head being taken up on said takeup core when said transfer head is moved upstream with respect to a direction of ribbon feeding from said feed core, while pressing said transfer ribbon upon said receiving surface;

wherein said transfer ribbon has a substantially entire length feedably wound on said feed core, with an outside diameter (E) of winding of said entire length set to the following ratio with respect to an outside diameter (d) of said feed core:

$$\text{outside diameter } (E)/\text{outside diameter } (d) = 2.2 \text{ at most.}$$

14. A paint film transfer device as defined in claim 13, wherein said transfer roller includes a peripheral surface having a roller width (kr) set to the following ratio with respect to a width (K) of said transfer ribbon:

$$\text{roller width } (Kr)/\text{ribbon width } (K) = 1.2 \text{ to } 2.5.$$

15. A paint film transfer device comprising:

a feed core for winding a transfer ribbon to form transfer ribbon winding;

a transfer head;

a transfer roller rotatably supported to said transfer head movable upstream with respect to the direction of ribbon feeding from said feed core, while pressing a transfer surface of said transfer ribbon upon said receiving surface, said transfer roller including a peripheral surface having a ratio (Kr/K) of roller width (Kr) with a width (K) of said transfer ribbon set to between 1.2 to 2.5;

a takeup core for taking up said transfer ribbon having passed through said transfer head; and a slip interlock mechanism for interlocking said feed core and said takeup core such that said takeup core is rotatable faster than said feed core, with slippage allowed between rotation of said feed core and rotation of said takeup core;

said transfer ribbon becoming unwound while rotating said feed core, with a used portion of said transfer ribbon having passed through said transfer head being taken up on said takeup core when said transfer head is moved upstream with respect to a direction of ribbon feeding from said feed core, while pressing said transfer ribbon upon said receiving surface;

wherein said transfer ribbon has a substantially entire length feedably wound on said feed core, with an outside diameter (E) of winding of said entire length set to the following ratio with respect to an outside diameter (d) on said feed core:

*outside diameter (E)/outside diameter (d)=2.2 at most.*

16. A method of mounting a transfer ribbon wound on a feed core in a case utilizing a transfer ribbon cartridge, said method comprising the steps of:

mounting said feed core with said transfer ribbon wound thereon and a takeup core on a holder;

attaching said feed core and said takeup core onto said case with said holder attached to said feed core and said takeup core; and removing said holder from said feed core and said takeup core with said feed core and said takeup core attached to said case.

17. A paint film transfer device comprising:

a transfer ribbon cartridge including:

a plate-like holder;

a feed core and a takeup core, each rotatably supported at one end thereof by a plate-like holder, for winding a paint film transfer ribbon; and a case openable and closable for removably obtaining said transfer ribbon cartridge, said case supporting free axial ends of said feed core and said takeup core when said transfer ribbon cartridge is mounted therein;

said case including:

a first split case member;

a first reinforcing rib provided on an inner surface of said first split case member;

a second split case member;

a second reinforcing rib provided on an inner surface of said second split case member;

said first and second reinforcing members restricting movement of said plate-like holder in a direction of thickness thereof by holding said plate-like holder between said first and second reinforcing members.

18. A paint film transfer device as defined in claim 17, wherein said transfer ribbon has a substantially entire length feedably wound on said feed core, with an outside diameter (E) of winding of said entire length set to the following ratio with respect to an outside diameter (d) of said feed core:

*outside diameter (E)/outside diameter (d)=2.2 at most.*

19. A paint film transfer device as defined in claim 17, further comprising a transfer head in form of a transfer roller movable upstream with respect to a direction of ribbon feeding from said feed core, while pressing a transfer surface of said transfer ribbon upon a receiving surface, said transfer roller having an outside diameter of 8 mm to 20 mm.

20. A paint film transfer device as defined in claim 17, further comprising a transfer roller including a peripheral surface having a roller width (kr) set to the following ratio with respect to a width (K) of said transfer ribbon:

*roller width (Kr)/ribbon width (K)=1.2 to 2.5.*

* * * * *

UNITED STATES PATENT AND TRADEMARK OFFICE

CERTIFICATE OF CORRECTION

PATENT NO. : 5,499,877

DATED : March 19, 1996

INVENTOR(S) : Yutaka Sakanishi and Kotaro Akashiro

It is certified that error appears in the above-indentified patent and that said Letters Patent is hereby corrected as shown below:

Title page, section '[56] References Cited, U.S. PATENT DOCUMENTS', delete "4,861,177 8/1989 Heins et al. ... 400/208" and "5,160,206 11/1992 Haftmann et al. ... 400/250".

Title page, Abstract Line 1 after "cassette" insert --includes--.

Column 1 Line 23 "fight" should read --right--.

Column 5 Line 14 "390 gf. cm." should read --390gf · cm.--.

Column 5 Line 23 "requited" should read --required--.

Column 5 Line 62 "(3" should read --θ--.

Column 6 Line 64 "action" should read --section--.

Column 8 Line 31 "fight" should read --right--.

Column 12 Line 61 "fight" should read --right--.

Column 15 Line 8 "fight" should read --right--.

Column 15 Line 50 "390gf. cm" should read --390gf · cm--.

Claim 1 Line 12 Column 16 "transfer ribbon;" should read --a transfer ribbon;
a case;--.

UNITED STATES PATENT AND TRADEMARK OFFICE

CERTIFICATE OF CORRECTION

PATENT NO. : 5,499,877

DATED : March 19, 1996

INVENTOR(S) : Yutaka Sakanishi and Kotaro Akashiro

It is certified that error appears in the above-indentified patent and that said Letters Patent is hereby corrected as shown below:

Claim 1 Line 15 Column 16 "group;" should read --groove;--.

Claim 1 Line 31 Column 16 "surface." should read --surface,--.

Claim 12 Line 62 Column 17 "ribbon:" should read --ribbon;--.

Claim 12 Line 14 Column 18 "shafts," should read --shaft,--.

Claim 13 Line 25 Column 18 "core while" should read --core, while--.

Claim 13 Line 28 Column 18 "mm:" should read --mm;--.

Signed and Sealed this

Twenty-fourth Day of September, 1996

*Attest:*

*Attesting Officer*

BRUCE LEHMAN

*Commissioner of Patents and Trademarks*